US010783842B2

(12) United States Patent
Imai

(10) Patent No.: US 10,783,842 B2
(45) Date of Patent: Sep. 22, 2020

(54) DISPLAY DEVICE

(71) Applicant: Japan Display Inc., Tokyo (JP)

(72) Inventor: Ryo Imai, Tokyo (JP)

(73) Assignee: Japan Display Inc., Tokyo (JP)

( * ) Notice: Subject to any disclaimer, the term of this patent is extended or adjusted under 35 U.S.C. 154(b) by 1 day.

(21) Appl. No.: 16/137,671

(22) Filed: Sep. 21, 2018

(65) Prior Publication Data

US 2019/0108802 A1 Apr. 11, 2019

(30) Foreign Application Priority Data

Oct. 6, 2017 (JP) ..... 2017-196166

(51) Int. Cl.
*G09G 3/36* (2006.01)

(52) U.S. Cl.
CPC ..... *G09G 3/3607* (2013.01); *G09G 3/3614* (2013.01); *G09G 3/3674* (2013.01); *G09G 3/3685* (2013.01); *G09G 2310/0283* (2013.01); *G09G 2310/0291* (2013.01); *G09G 2310/08* (2013.01); *G09G 2330/021* (2013.01)

(58) Field of Classification Search
CPC .. G09G 3/3607; G09G 3/3614; G09G 3/3674; G09G 3/3685; G09G 2310/08; G09G 2310/0291; G09G 2330/021; G09G 2310/0283; G09G 3/2022; G09G 3/2096; G09G 3/3688; G09G 3/3648; G09G 2310/0213; G09G 2320/0247; G09G 2310/04; G09G 2310/0297; G09G 2320/0673; G09G 2320/0271
See application file for complete search history.

(56) References Cited

U.S. PATENT DOCUMENTS

2001/0033278 A1* 10/2001 Ohta ..... G09G 3/3677 345/204
2002/0008688 A1* 1/2002 Yamamoto ..... G09G 3/3648 345/98
2002/0030620 A1* 3/2002 Cairns ..... G09G 3/3688 341/145
2008/0074568 A1* 3/2008 Tanaka ..... G09G 3/3406 349/37

(Continued)

FOREIGN PATENT DOCUMENTS

JP 2017-040809 A 2/2017
JP 2017-40908 2/2017
JP 2017-196166 A 11/2017

*Primary Examiner* — Mark W Regn
(74) *Attorney, Agent, or Firm* — K&L Gates LLP

(57) ABSTRACT

A display device includes an image display panel comprising a plurality of pixels that each comprise a plurality of sub-pixels to display different colors and that are arranged in a matrix, a plurality of scan lines coupled to the respective sub-pixels arranged in a row direction, and a plurality of signal lines coupled to the respective sub-pixels arranged in a column direction, and a driver configured to be supplied with a video signal having a predetermined number of gradations and configured to drive the image display panel, and having a first display mode of performing display with the number of gradations of the video signal, and a second display mode of performing the display with a number of gradations smaller than a number of gradations of the video signal and larger than two.

7 Claims, 25 Drawing Sheets

(56) References Cited

U.S. PATENT DOCUMENTS

| | | | | |
|---|---|---|---|---|
| 2013/0241859 | A1* | 9/2013 | Saitoh | G06F 3/041 345/173 |
| 2016/0372084 | A1* | 12/2016 | Wang | G09G 5/18 |
| 2017/0053592 | A1 | 2/2017 | Shin et al. | |
| 2019/0243058 | A1* | 8/2019 | Kikuchi | F21S 2/00 |

* cited by examiner

DISPLAY DEVICE

CROSS-REFERENCE TO RELATED APPLICATIONS

This application claims priority from Japanese Application No. 2017-196166, filed on Oct. 6, 2017, the contents of which are incorporated by reference herein in its entirety.

BACKGROUND

1. Technical Field

The present disclosure relates to a display device.

2. Description of the Related Art

In battery-driven portable information terminal apparatuses, such as smartphone terminals and wearable terminals, a function (hereinafter, called "power-saving full-time display") is widely used that always displays certain information, such as time, date, a calendar, and/or an incoming state, while keeping power consumption low. At the same time, display devices capable of being driven with lower power are desired for such portable information terminal apparatuses. For example, Japanese Patent Application Laid-open Publication No. 2017-040908 A discloses that a video is displayed by low-frequency driving.

To reduce the power during the power-saving full-time display, for example, eight-color display can be performed using the highest-order bits of respective colors (red, green, and blue) of image data. However, the number of colors for color representation is desired to be increased even during the power-saving full-time display.

It is an object of the present disclosure to provide a display device capable of operating at lower power while performing the multi-color display during the power-saving full-time display.

SUMMARY

A display device according to one embodiment of the present disclosure includes an image display panel comprising a plurality of pixels that each comprise a plurality of sub-pixels to display different colors and that are arranged in a matrix, a plurality of scan lines coupled to the respective sub-pixels arranged in a row direction, and a plurality of signal lines coupled to the respective sub-pixels arranged in a column direction, and a driver configured to be supplied with a video signal having a predetermined number of gradations and configured to drive the image display panel, and having a first display mode of performing display with the number of gradations of the video signal, and a second display mode of performing the display with a number of gradations smaller than a number of gradations of the video signal and larger than two. The driver includes a plurality of first amplifiers configured to amplify, in the first display mode, signals to be supplied to the respective pixels arranged in the column direction, second amplifiers that are smaller in number than the first amplifiers and that are configured to amplify, in the second display mode, gradation signals obtained by temporally dividing several types of voltages corresponding to a number of displayed gradations in one horizontal period, and a switching unit configured to switch between outputs of the first amplifiers and outputs of the second amplifiers to output the selected outputs to the signal lines.

A display device according to one embodiment of the present disclosure includes an image display panel comprising a plurality of pixels arranged in a matrix, a plurality of scan lines coupled to the respective pixels arranged in a row direction, and a plurality of signal lines coupled to the respective pixels arranged in a column direction, and a driver configured to be supplied with a video signal having a predetermined number of gradations and configured to drive the image display panel, and having a first display mode of performing display with the number of gradations of the video signal, and a second display mode of performing the display with a number of gradations smaller than a number of gradations of the video signal and larger than two. The driver is configured to supply signals having first gradations to the respective pixels arranged in the column direction in the first display mode, and supply signals having second gradations smaller in number than the first gradations to the respective pixels arranged in the column direction in the second display mode.

DETAILED DESCRIPTION

Figure 1:
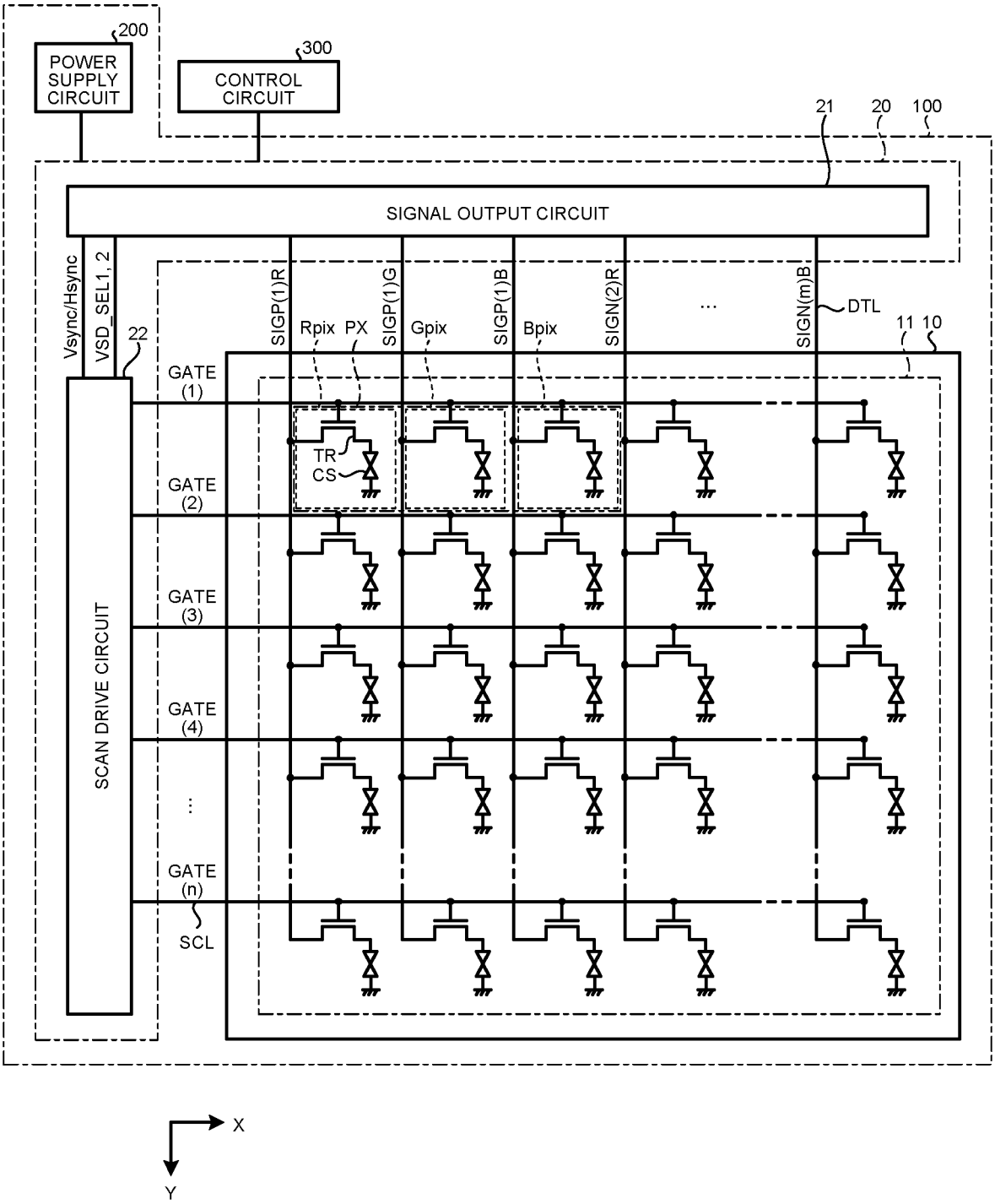
FIG. 1 is a diagram illustrating a configuration example of a display device according to an embodiment of the present disclosure.

The following describes a mode (embodiment) for carrying out the present disclosure in detail with reference to the drawings. The present disclosure is not limited to the description of the embodiment to be given below. Components to be described below include those easily conceivable by those skilled in the art or those substantially identical thereto. Furthermore, the components to be described below can be combined as appropriate. The disclosure is merely an example, and the present disclosure naturally encompasses appropriate modifications easily conceivable by those skilled in the art while maintaining the gist of the disclosure. To further clarify the description, widths, thicknesses, shapes, and the like of various parts will be schematically illustrated as compared with actual aspects thereof, in some cases. However, they are merely examples, and interpretation of the present disclosure is not limited thereto. The same element as that illustrated in a drawing that has already been discussed is denoted by the same reference numeral through the description and the drawings, and detailed description thereof will not be repeated in some cases where appropriate.

FIG. 1 is a diagram illustrating a configuration example of a display device according to the embodiment.

A display device 100 according to the embodiment is supplied with various power supply voltages from a power supply circuit 200 of, for example, an electronic apparatus with the display device 100 mounted thereon, and performs image display based on output signals output from a control circuit 300 serving as a host processor of, for example, the electronic apparatus. Examples of the electronic apparatus with the display device 100 mounted thereon include, but are not limited to, an information terminal apparatus, such as a smartphone.

In the example illustrated in FIG. 1, the display device 100 is, for example, a transmissive or reflective liquid crystal display device, and includes an image display panel 10 serving as a color liquid crystal display panel, an image display panel driver 20, and the power supply circuit 200 that is coupled to the image display panel driver 20 and generates power supply voltages to be applied to the image display panel driver 20.

The control circuit 300 is an arithmetic processor that controls operations of the display device 100 according to the present embodiment. The control circuit 300 is coupled to the image display panel driver 20.

A plurality of pixels PX are arranged in a matrix to form a display area 11 on the image display panel 10. In the example illustrated in FIG. 1, the m×n pixels (m pixels in a row direction and n pixels in a column direction) PX are arranged in a two-dimensional matrix on the image display panel 10. The example illustrated in FIG. 1 represents an example in which the pixels PX are arranged in a matrix in a two-dimensional XY-coordinate system. In this example, the row direction corresponds to the X-direction, and the column direction corresponds to the Y-direction. Hereinafter, the pixels PX arranged in the X-direction (row direction) are referred to as a "pixel row", and the pixels PX arranged in the Y-direction (column direction) are referred to as a "pixel column".

Each of the m×n pixels PX includes a first sub-pixel Rpix, a second sub-pixel Gpix, and a third sub-pixel Bpix. The first sub-pixel Rpix displays a first color (such as red). The second sub-pixel Gpix displays a second color (such as green). The third sub-pixel Bpix displays a third color (such as blue). The first color, the second color, and the third color are not limited to red, green, and blue, and may be complementary colors thereof, only needing to be different colors from one another. In the following description, the first sub-pixel Rpix, the second sub-pixel Gpix, and the third sub-pixel Bpix will each be called a sub-pixel SPix when need not be distinguished from one another. In the present embodiment, the sub-pixels SPix included in each of the pixels PX are three sub-pixels of red (R), green (G), and blue (B). The present disclosure is, however, not limited to this. The sub-pixels SPix included in each of the pixels PX may be four sub-pixels of red (R), green (G), blue (B), and white (W) in addition thereto, or may be five or more sub-pixels of different colors.

Each of the sub-pixels SPix includes a pixel transistor (such as a thin-film transistor (TFT)) TR and a pixel capacitor CS.

In the present embodiment, since each of the pixels PX includes the three sub-pixels SPix, the m×n×3 sub-pixels SPix are arranged in the display area 11. In the present embodiment, the three sub-pixels SPix in each of the m×n pixels PX are arranged in the X-direction (row direction). Consequently, the m×3 sub-pixels SPix are arranged in each row of the m×n pixels PX.

The image display panel driver 20 includes a signal output circuit 21 and a scan drive circuit 22.

The image display panel driver 20 holds a video signal in the signal output circuit 21, and sequentially outputs the video signal to the image display panel 10. The signal output circuit 21 is electrically coupled to the image display panel 10 through signal lines DTL, and transmits sub-pixel signals SIG(1)R, SIG(1)G, SIG(1)B, SIG(2)R, . . . , SIG(m)B to be written to the respective sub-pixels SPix. Each of the sub-pixel signals SIG(1)R, SIG(1)G, SIG(1)B, SIG(2)R, . . . , SIG(m)B is supplied to the sources of the pixel transistors TR of the respective sub-pixels SPix in corresponding one of the pixel columns.

The present embodiment is configured to transmit each of the sub-pixel signals by temporally dividing each pixel signal for corresponding one of the pixel columns.

The display device 100 according to the present embodiment is exemplified to have a configuration using an inversion driving system of driving the image display panel 10 by reversing the polarity of the signal to be supplied to each of the pixels PX on a frame-by-frame basis. The following description exemplifies a configuration of reversing the polarity between positive and negative polarities alternately between pixel columns on a frame-by-frame basis. The inversion driving system is, however, not limited to this example. For example, the inversion driving system may be a system of reversing the sub-pixels of the entire screen into the same polarity at the same time on a frame-by-frame basis, or may be a system in which a direct-current common voltage VcomDC serving as a constant direct-current voltage is applied to a common electrode VCOM, and the polarity is reversed for each predetermined number of the signal lines DTL, and also the polarity of each of the signal lines DTL is reversed on a frame-by-frame basis. The present disclosure is not limited by differences in the inversion driving system.

The image display panel driver 20 uses the scan drive circuit 22 constituted by, for example, shift registers to select each of the pixel rows, and controls on and off of the pixel transistor TR of each of the sub-pixels SPix. The scan drive circuit 22 is electrically coupled to the image display panel 10 through scan lines SCL, and transmits scan signals GATE(1), GATE(2), GATE(3), GATE(4), . . . , GATE(n). Each of the scan signals GATE(1), GATE(2), GATE(3), GATE(4), . . . , GATE(n) is supplied to the gates of the pixel transistors TR of the respective sub-pixels SPix in corresponding one of the pixel rows.

In the present embodiment, the display device 100 configured as described above has a first display mode of performing multi-color display (in, for example, approximately 16.77M colors) with the number of gradations (such as 256 gradations for each color of red, green, and blue) of the video signal (such as a 24-bit signal, i.e., 8 bits for each color of red, green, and blue ×3) output from the control circuit 300 and a second display mode of performing display in the number of colors more limited than the number of colors of the first display mode, and the two display modes can be dynamically switched therebetween. In the present embodiment, when the display is performed in the second display mode, the display is performed with the number of gradations smaller than the number of gradations of the video signal and larger than two (for example, using a 6-bit signal having four gradations for each of the colors of red, green, and blue using the 2 higher-order bits of the 8 bits for each color).

Figure 2:
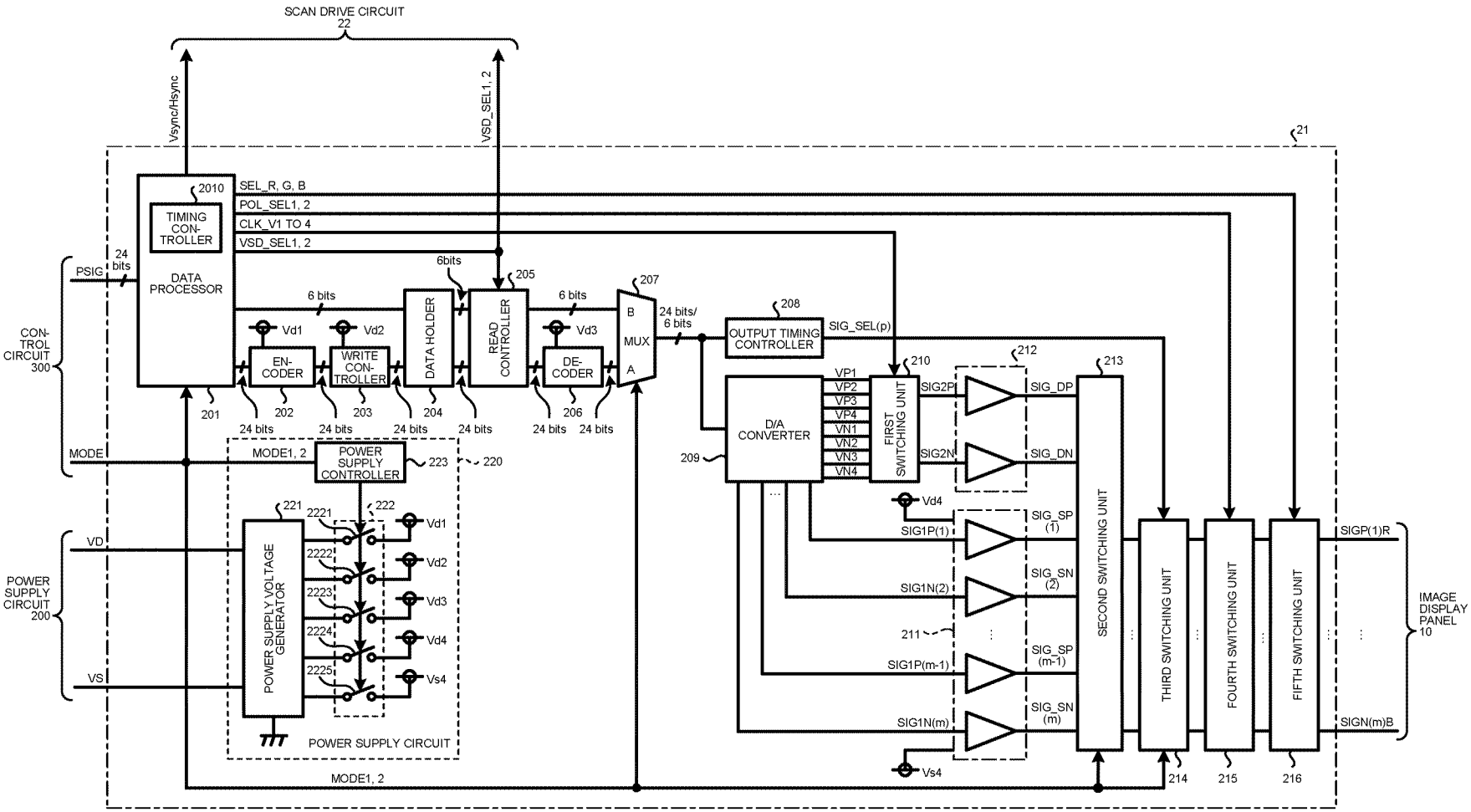
FIG. 2 is a diagram illustrating an exemplary internal block configuration of a signal output circuit of the display device according to the embodiment.

FIG. 2 is a diagram illustrating an exemplary internal block configuration of the signal output circuit of the display device according to the embodiment.

The signal output circuit 21 receives a video signal PSIG and a mode switching signal MODE from the control circuit 300, and performs processing to display an image of the video signal PSIG in the display area 11 of the image display panel 10 in a display mode selected by the mode switching signal MODE, that is, in a first display mode MODE1 or a second display mode MODE2.

As illustrated in FIG. 2, the signal output circuit 21 includes a data processor 201, an encoder 202, a write controller 203, a data holder 204, a read controller 205, a decoder 206, a multiplexer (MUX) 207, an output timing controller 208, a digital-to-analog (D/A) converter 209, a first switching unit 210, first amplifiers 211, second amplifiers 212, a second switching unit 213, a third switching unit 214, a fourth switching unit 215, a fifth switching unit 216, and a power supply circuit 220. The power supply circuit 220 includes a power supply voltage generator 221, a power supply switch circuit 222, and a power supply controller 223.

The power supply voltage generator 221 is a circuit that receives a positive voltage VD and a negative voltage VS from the power supply circuit 200, and supplies the power supply voltages to the components included in the signal output circuit 21. Although the example illustrated in FIG. 2 represents a configuration of generating a power supply voltage Vd1 to be supplied to the encoder 202, a power supply voltage Vd2 to be supplied to the write controller 203, a power supply voltage Vd3 to be supplied to the decoder 206, a positive power supply voltage Vd4 to be supplied to the first amplifiers 211, and a negative power supply voltage Vs4 to be supplied to the first amplifiers 211, the power supply voltage generator 221 also has a function of generating the power supply voltages to be supplied to the other components.

The power supply voltage Vd1, the power supply voltage Vd2, the power supply voltage Vd3, the positive and negative power supply voltages Vd4 and Vs4 are supplied to the encoder 202, the write controller 203, the decoder 206, and the first amplifiers 211, respectively, through the power supply switch circuit 222.

The power supply controller 223 is a circuit that controls the power supply switch circuit 222 based on the mode switching signal MODE. In the present embodiment, the power supply controller 223 has a function of controlling the power supply switch circuit 222 to be turn off to stop supplying the power to the encoder 202, the write controller 203, the decoder 206, and the first amplifiers 211 when the mode switching signal MODE represents the second display mode MODE2.

More specifically, the power supply switch circuit 222 includes a switch 2221 that stops the power supply voltage Vd1 from being supplied to the encoder 202 in the second display mode MODE2, a switch 2222 that stops the power supply voltage Vd2 from being supplied to the write controller 203 in the second display mode MODE2, a switch 2223 that stops the power supply voltage Vd3 from being supplied to the decoder 206 in the second display mode MODE2, and switches 2224 and 2225 that stop the positive power supply voltage Vd4 and the negative power supply voltage Vs4, respectively, from being supplied to the first amplifiers 211 in the second display mode MODE2.

The power supply voltages Vd1, Vd2, and Vd3 may be the same power supply voltage, or power supply voltages different from one another. If any two or three of the power supply voltages Vd1, Vd2, and Vd3 are the same power supply voltage, any the two or three thereof may be output as a common power supply output.

The data processor 201 includes a timing controller 2010 that performs timing control when the image display is performed.

Figure 3:
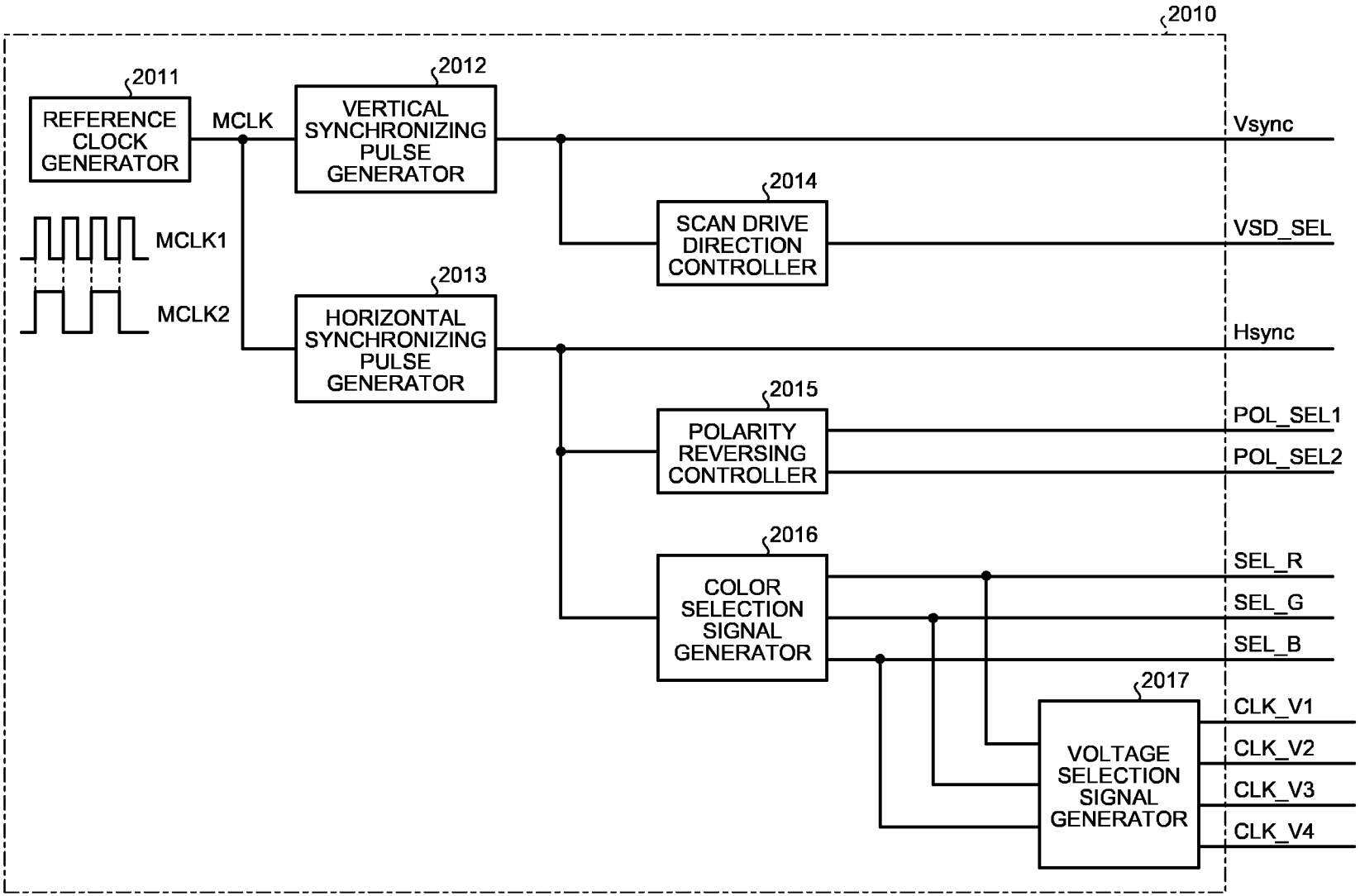
FIG. 3 is a diagram illustrating a configuration example of a timing controller.
Figure 4:
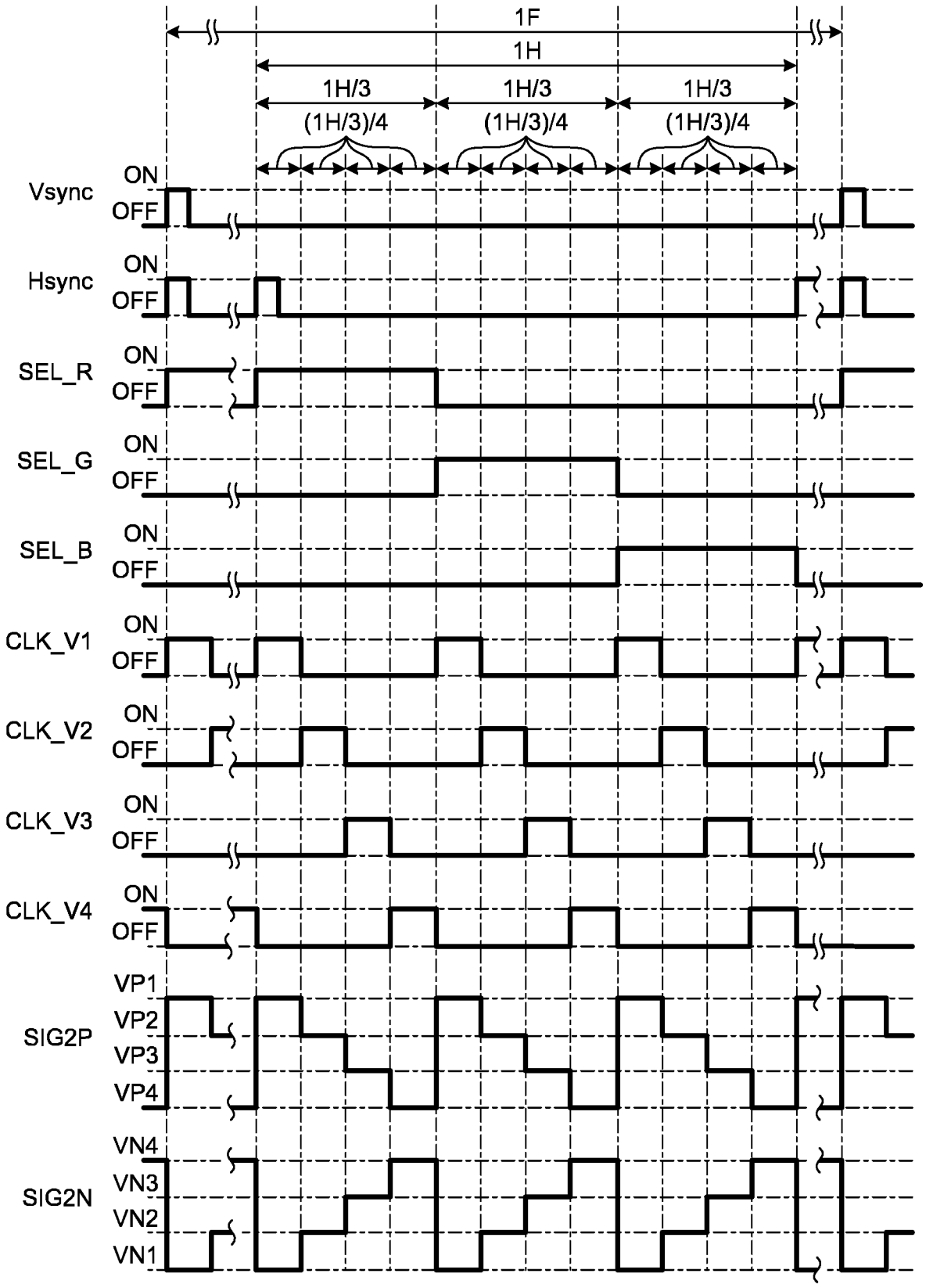
FIG. 4 is a timing diagram of signals.

FIG. 3 is a diagram illustrating a configuration example of the timing controller. FIG. 4 is a timing diagram of signals. As illustrated in FIG. 3, the timing controller 2010 includes a reference clock generator 2011, a vertical synchronizing pulse generator 2012, a horizontal synchronizing pulse generator 2013, a scan drive direction controller 2014, a polarity reversing controller 2015, a color selection signal generator 2016, and a voltage selection signal generator 2017.

The reference clock generator 2011 generates a main clock signal MCLK serving as a reference for the timing control when the image display is performed.

The vertical synchronizing pulse generator 2012 generates a vertical synchronizing pulse Vsync based on the main clock signal MCLK when the image display is performed.

The horizontal synchronizing pulse generator 2013 generates a horizontal synchronizing pulse Hsync based on the main clock signal MCLK when the image display is performed.

The scan drive direction controller 2014 is a component that controls the direction of scanning of the scan lines SCL by the scan drive circuit 22 based on the vertical synchronizing pulse Vsync. The scan drive direction controller 2014 outputs a scanning direction signal VSD_SEL for defining the direction of scanning of the scan lines SCL by the scan drive circuit 22.

The polarity reversing controller 2015 is a component that controls, based on the horizontal synchronizing pulse Hsync, the polarity of the signal to be supplied to each of the pixels PX. The polarity reversing controller 2015 outputs a first polarity signal POL_SEL1 and a second polarity signal POL_SEL2 for defining the polarity of the signal to be supplied to each of the pixels PX.

Based on the horizontal synchronizing pulse Hsync, the color selection signal generator 2016 temporally divides a horizontal period 1H into three periods of equal intervals (1H/3), and generates color selection signals SEL_R, SEL_G, and SEL_B that serve as on-signals in the respective periods, as illustrated in FIG. 4.

The voltage selection signal generator 2017 temporally divides an on-period of each of the color selection signals SEL_R, SEL_G, and SEL_B into a plurality of (four here) periods of equal intervals ((1H/3)/4), and generates voltage selection signals CLK_V1, CLK_V2, CLK_V3, and CLK_V4 that serve as on-signals in the respective periods, as illustrated in FIG. 4.

The data processor 201 performs processing based on the video signal PSIG received from the control circuit 300 for performing the display in the first display mode MODE1 or the second display mode MODE2.

Specifically, the data processor 201 outputs the 24-bit (8 bits for each color of red, green, and blue ×3) signal serving as a signal of first gradations for performing the display in the first display mode MODE1, to the encoder 202.

The data processor 201 extracts the 2 higher-order bits of each color from the 24-bit signal for performing the display in the first display mode MODE1, generates the 6-bit (2 bits for each color of red, green, and blue ×3) signal serving as a signal of second gradations for performing the display in the second display mode MODE2, and stores the generated the 6-bit signal in the data holder 204.

The encoder 202 compresses the received 24-bit signal. The write controller 203 stores the 24-bit signal compressed by the encoder 202 in the data holder 204.

The data holder 204 is a semiconductor memory, such as a static random access memory (SRAM).

The data holder 204 has a (buffer) function of temporarily holding the compressed 24-bit signal or the 6-bit signal. The 24-bit signal or the 6-bit signal is stored on a fame-by-frame basis of the video signal PSIG.

The read controller 205 controls reading of the 24-bit signal or the 6-bit signal stored in the data holder 204. The 24-bit signal read by the read controller 205 is output to the decoder 206.

The decoder 206 expands the received 24-bit signal to restore the 24-bit signal that is before compressed.

After the first display mode MODE1 is selected by the mode switching signal MODE, the multiplexer (MUX) 207 selects and outputs the 24-bit signal received through an input A. After the second display mode MODE2 is selected by the mode switching signal MODE, the multiplexer (MUX) 207 selects and outputs the 6-bit signal received through an input B. In other words, the multiplexer (MUX) 207 selectively outputs the 24-bit signal or the 6-bit signal according to the mode switching signal MODE.

Figure 5:
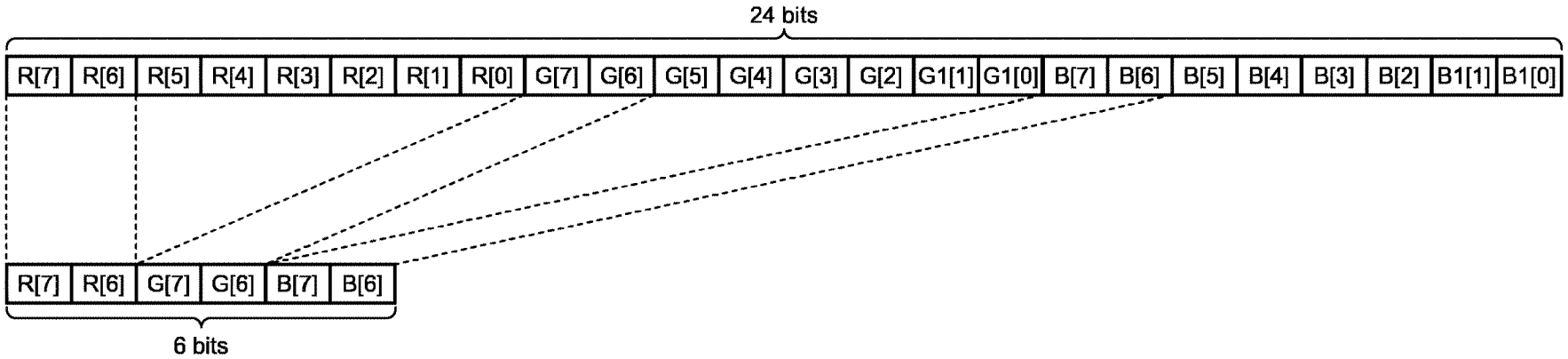
FIG. 5 is a diagram illustrating a 24-bit signal for display in a first display mode and a 6-bit signal for display in a second display mode.

FIG. 5 is a diagram illustrating the 24-bit signal for performing the display in the first display mode and the 6-bit signal for performing the display in the second display mode.

As illustrated in FIG. 5, in the present embodiment, the 6-bit signal (signal of second gradations) for performing the display in the second display mode MODE2 is generated using the 2 higher-order bits of the 8 bits for each color of red, green, and blue in the 24-bit signal (signal of first gradations) for performing the display in the first display mode MODE1. The 6-bit signal can represent four gradations for each color of red, green, and blue, and enables 64 colors to be displayed in a smaller number of display colors than the display in 16.77M colors in the first display mode MODE1. However, the data volume is reduced to a quarter that of the 24-bit signal for performing the display in the first display mode MODE1, as illustrated in FIG. 5. Consequently, the second display mode MODE2 can omit the compression processing by the encoder 202 and the expansion processing by the decoder 206, and thus can operate in logic stages at lower power than the first display mode MODE1.

If the display is performed with two gradations for each color of red, green, and blue, the data volume is reduced to a half that of the 6-bit signal. In this case, however, the number of display colors is reduced to an eighth (8-color display) that of the display colors (64-color display) represented by the 6-bit signal, and the color representation is significantly degraded. In the present embodiment, the 6-bit signal for performing the display in the second display mode MODE2 is generated using the 2 higher-order bits of the 8 bits for each color of red, green, and blue, whereby, more colorful color representation than that of the two-gradation display can be performed while reducing the data volume and the power.

The output timing controller 208 is a component that controls, in the second display mode MODE2, output timing of signals in the third switching unit 214 in the subsequent stage based on the 6-bit signal for performing the display in the second display mode MODE2. The output timing controller 208 outputs each output timing switching signal SIG_SEL(p) (where p is an integer from 1 to m) that defines output timing for each of the pixel columns in the second display mode MODE2.

The D/A converter 209 has a function of converting the 24-bit digital signal for performing the display in the first display mode MODE1 into respective signals SIG1P(p) and SIG1N(p+1) of analog values to be supplied to the respective pixel columns, and outputting the results. As described above, in the present embodiment, the image display panel 10 is driven using the inversion driving system of reversing the polarity of the signal to be supplied to each of the pixels PX on a frame-by-frame basis. In other words, the number of the signals SIG1P(p) and SIG1N(p+1) is equal to the number of the pixels PX arranged in the row direction (specifically, m), and the polarities of pixel signals supplied to adjacent pixel columns differ from each other. Specifically, for example, the polarity of the signal SIG1P(1) differs from that of the signal SIG1N(2), and the polarity of the signal SIG1N(2) differs from that of the signal SIG1P(3).

The D/A converter 209 also has a function of converting the 6-bit digital signal for performing the display in the second display mode MODE2 into a plurality of types of voltages corresponding to the number of gradations (four gradations here) of the digital signal, and outputting the results.

Figure 6:
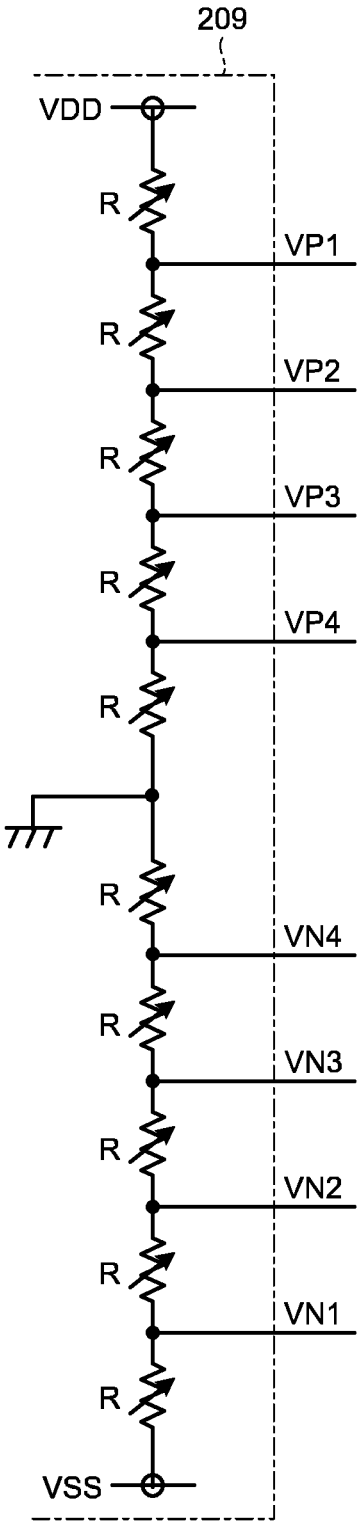
FIG. 6 is a diagram illustrating an exemplary internal configuration of a digital-to-analog (D/A) converter for outputting a plurality of types of voltages corresponding to the number of gradations when the display is performed in the second display mode.

FIG. 6 is a diagram illustrating an exemplary internal configuration of the digital-to-analog (D/A) converter for outputting the several types of voltages corresponding to the number of gradations when the display is performed in the second display mode.

FIG. 6 exemplifies a resistor ladder circuit in which resistors R are coupled in series between a positive power supply VDD and a negative power supply VSS. In the present embodiment, when the display is performed in the second display mode MODE2, each color of red, green, and blue needs to be displayed with four gradations. As described above, in the present embodiment, the image display panel 10 is driven using the inversion driving system of reversing the polarity of the signal to be supplied to each of the pixels PX on a frame-by-frame basis. For this purpose, the D/A converter 209 outputs four positive voltages VP1, VP2, VP3, and VP4 and four negative voltages VN1, VN2, VN3, and VN4 from nodes between the respective resistors R. The positive voltage VP1 and the negative voltage VN1 are different in polarity and substantially equal in potential difference from reference potential (or, ground potential). The positive voltage VP2 and the negative voltage VN2 are different in polarity and substantially equal in potential difference from reference potential. The positive voltage VP3 and the negative voltage VN3 are different in polarity and substantially equal in potential difference from reference potential. The positive voltage VP4 and the negative voltage VN4 are different in polarity and substantially equal in potential difference from reference potential.

The internal configuration of the D/A converter 209 for outputting the several types of voltages corresponding to the number of gradations when the display is performed in the second display mode may differ from that of the resistor ladder circuit illustrated in FIG. 6.

The D/A converter 209 may be configured to both output the signals SIG1P(p) and SIG1N(p+1) and output the four positive voltages VP1, VP2, VP3, and VP4 and the four negative voltages VN1, VN2, VN3, and VN4 regardless of whether the mode is the first display mode MODE1 or the second display mode MODE2. The D/A converter 209 may alternatively be configured to output the signals SIG1P(p) and SIG1N(p+1) in the first display mode MODE1, and output the four positive voltages VP1, VP2, VP3, and VP4 and the four negative voltages VN1, VN2, VN3, and VN4 in the second display mode MODE2. In other words, the D/A converter 209 may be configured to switch between the 24-bit signal for performing the display in the first display mode MODE1 and the 6-bit signal for performing the display in the second display mode MODE2, and process the selected signal.

Figure 7:
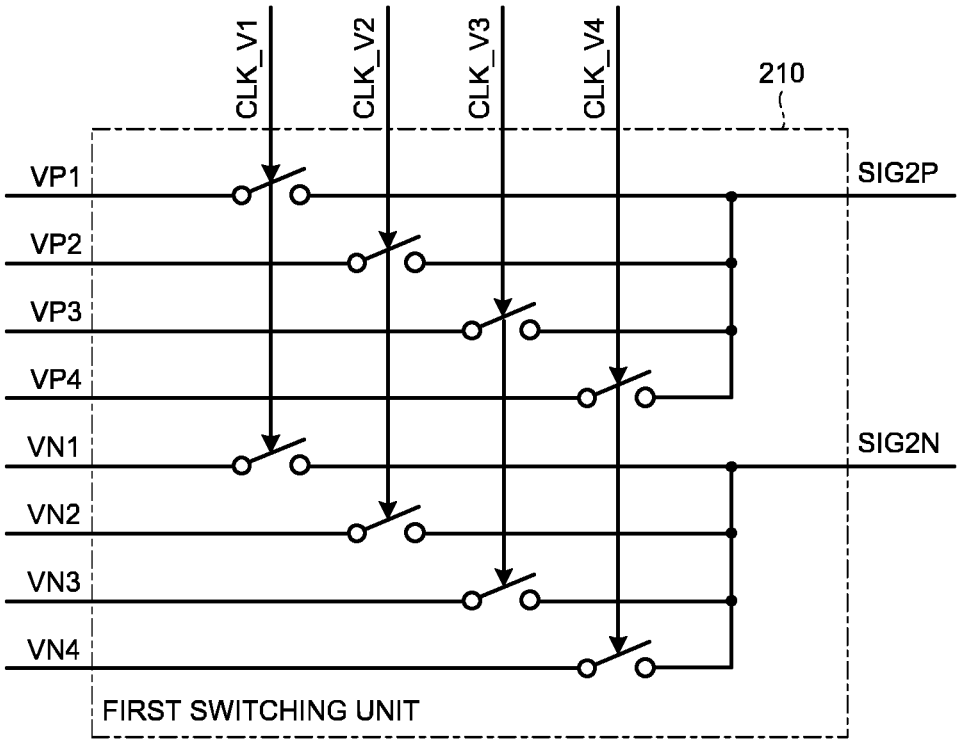
FIG. 7 is a diagram illustrating an example of a first switching unit.

FIG. 7 is a diagram illustrating an example of the first switching unit. The first switching unit 210 receives the four positive voltages VP1, VP2, VP3, and VP4 and the four negative voltages VN1, VN2, VN3, and VN4, and receives the voltage selection signals CLK_V1, CLK_V2, CLK_V3, and CLK_V4 to switch respective switches at respective times illustrated in FIG. 4, whereby gradation signals SIG2P and SIG2N illustrated in FIG. 4 are output.

The first amplifiers 211 are amplifier circuits that amplify the signals SIG1P(p) and SIG1N(p+1) to be supplied to each of the pixel columns, and output the results as first pixel signals SIG_SP(p) and SIG_SN(p+1) in the first display mode MODE1.

The second amplifiers 212 are amplifier circuits that amplify the gradation signals SIG2P and SIG2N, and output the results as gradation signals SIG_DP and SIG_DN in the second display mode MODE2.

The number of the first amplifiers 211 that amplify the respective signals SIG1P(p) and SIG1N(p+1) to be supplied to the respective pixel columns when the display is performed in the first display mode MODE1 is required to be equal to the number of the pixel columns, in other words, the number corresponding to the resolution in the X-direction (row direction). However, the number of the second amplifiers 212 used when the display is performed in the second display mode MODE2 is two. In other words, when the display is performed in the second display mode MODE2, the power supply to the first amplifiers 211 corresponding to the number of the pixel columns can be stopped, and thus, the power in analog stages can be lower than that of the first display mode MODE1. The power supply to the second amplifiers 212 may be configured to be capable of being stopped when the display is performed in the first display mode MODE1. Such a configuration can reduce the power when the display is performed in the first display mode MODE1.

Figure 8:
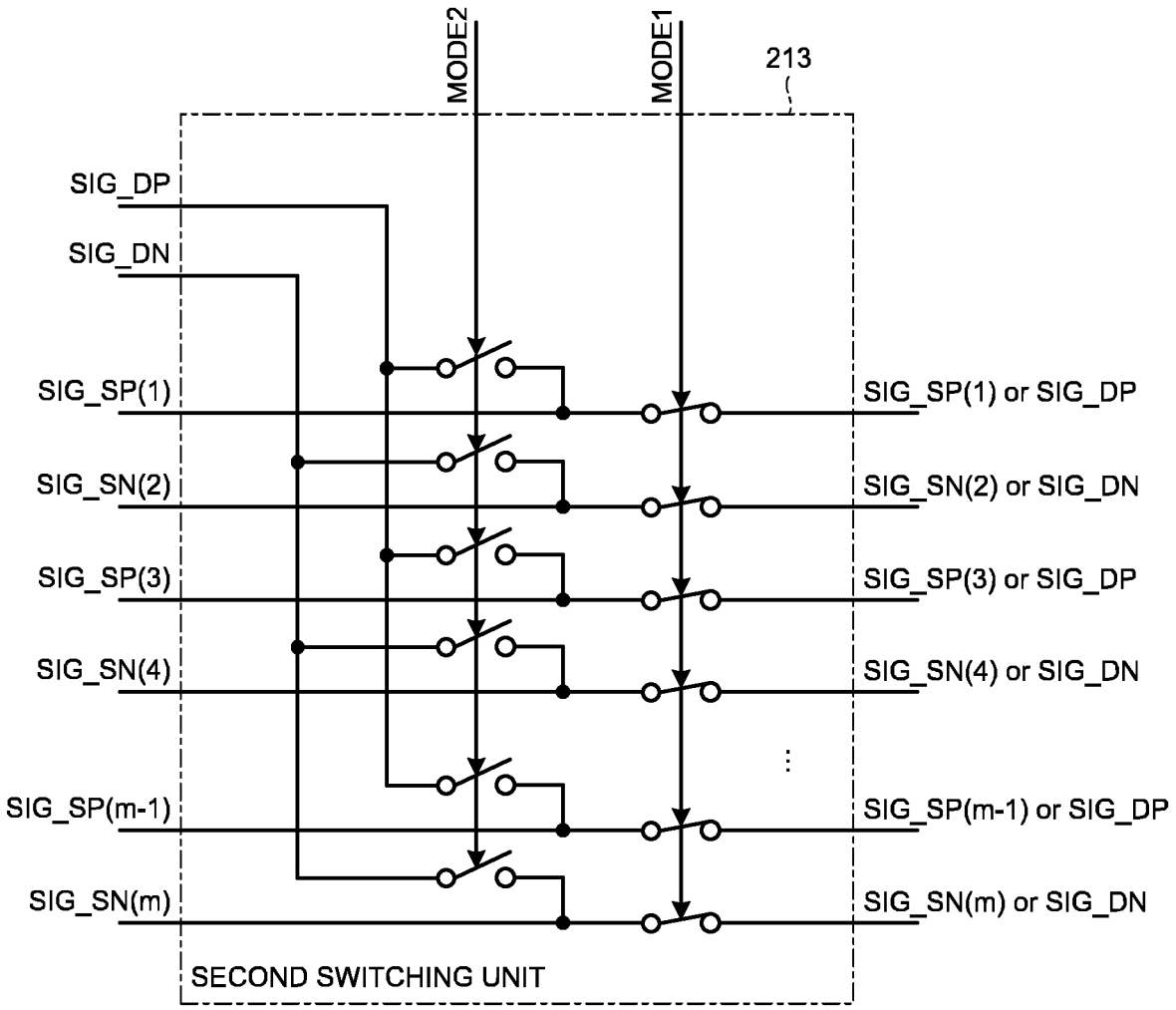
FIG. 8 is a diagram illustrating an example of a second switching unit.

FIG. 8 is a diagram illustrating an example of the second switching unit. In response to the mode switching signal MODE (MODE1 or MODE2), the second switching unit 213 switches between the first pixel signals SIG_SP(q) (q represents odd numbers among p) received from some of the first amplifiers 211 and the gradation signal SIG_DP received from one of the second amplifiers 212, and switches between the first pixel signals SIG_SN(r) (r represents even numbers among p) received from the others of the first amplifiers 211 and the gradation signal SIG_DN received from the other of the second amplifiers 212. In other words, the first pixel signals SIG_SP(q) and SIG_SN (r) are output in the first display mode MODE1, and either one of the gradation signal SIG_DP and the gradation signal SIG_DN is output in the second display mode MODE2. The example illustrated in FIG. 8 represents the state in the first display mode MODE1. In the second display mode MODE2, the on/off control state of each of the switches is reversed.

Figure 9A:
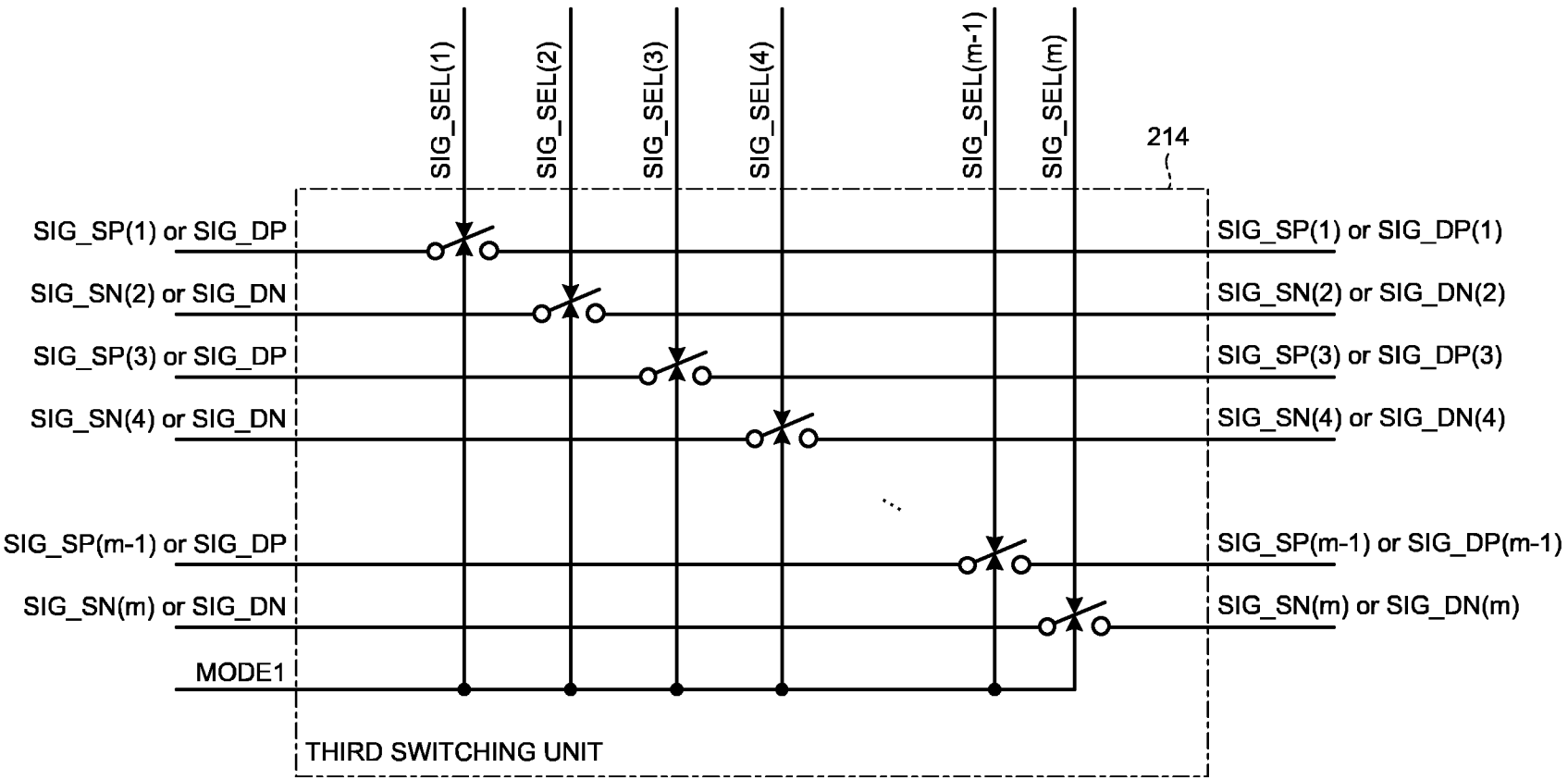
FIG. 9A is a diagram illustrating an example of a third switching unit.

FIG. 9A is a diagram illustrating an example of the third switching unit. The third switching unit 214 receives the first pixel signals SIG_SP(q) and SIG_SN(r) or the gradation signals SIG_DP and SIG_DN. In the first display mode MODE1, in response to the mode switching signal MODE (MODE1), all the switches are turned on to output the first pixel signals SIG_SP(q) and SIG_SN(r). In the second display mode MODE2, the gradation signals SIG_DP and SIG_DN are time-divisionally switched therebetween in response to each of the output timing switching signal SIG_SEL(p) received from the output timing controller 208. Thus, the voltage applied to each of the pixel columns is switched in the second display mode MODE2, and second pixel signals SIG_DP(q) and SIG_DN(r) serving as pixel signals when the display is performed in the second display mode MODE2 are generated and output.

Figure 9B:
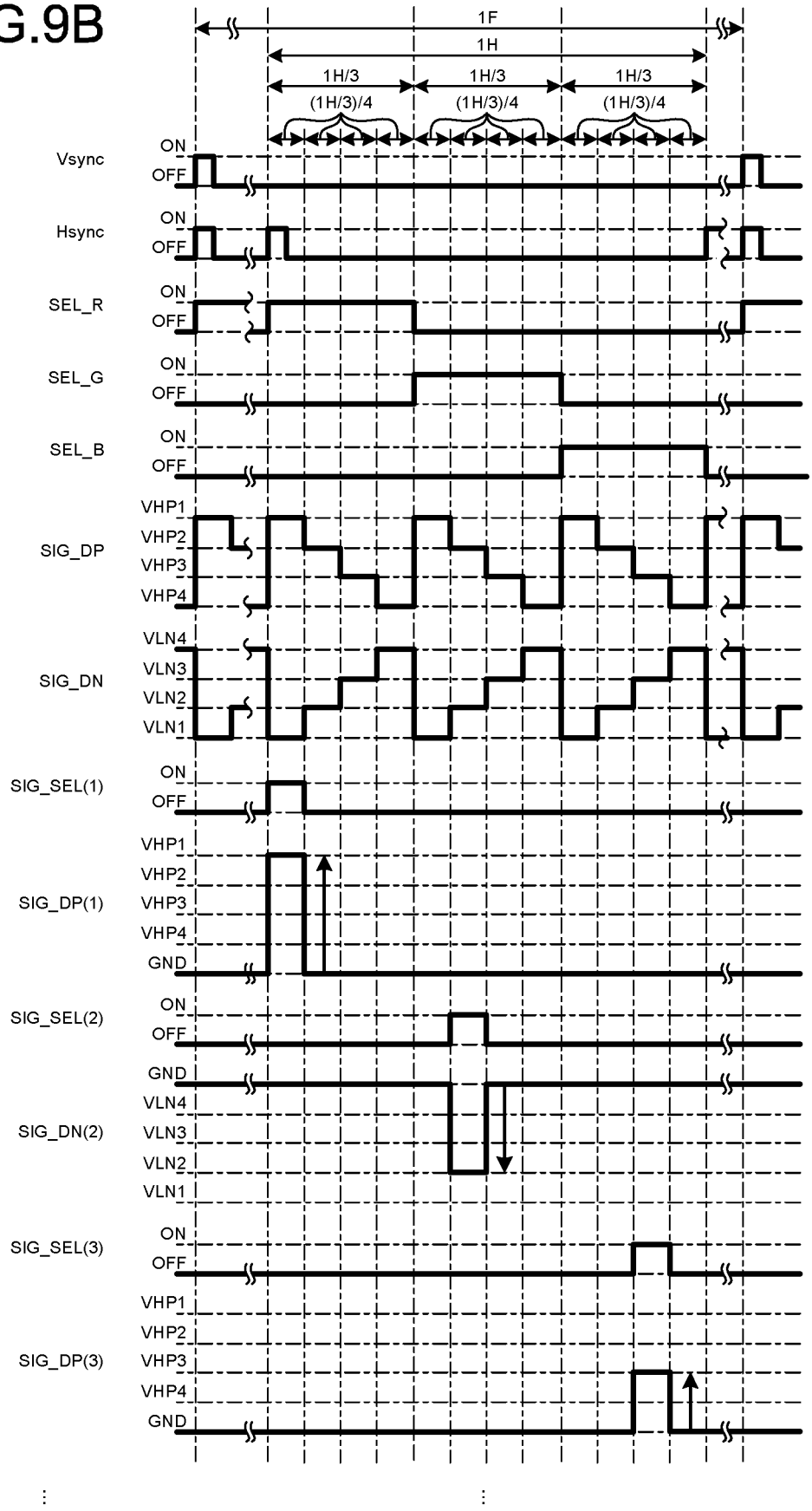
FIG. 9B is a diagram illustrating an exemplary output timing diagram of the third switching unit in the second display mode.

FIG. 9B is a diagram illustrating an exemplary output timing diagram of the third switching unit in the second display mode.

FIG. 9B illustrates an example of receiving the output timing switching signal SIG_SEL(1) in a red selection period (high-period of the color selection signal SEL_R) of the horizontal period 1H, receiving the output timing switching signal SIG_SEL(2) in a green selection period (high-period of the color selection signal SEL_G) of the horizontal period 1H, and receiving the output timing switching signal SIG_SEL(3) in a blue selection period (high-period of the color selection signal SEL_B) of the horizontal period 1H.

As illustrated in FIG. 9B, in the present embodiment, in each of these color selection periods of the horizontal period 1H, the output timing switching signal SIG_SEL(p) is output from the output timing controller 208 at the time of any one of four periods obtained by further temporally dividing each of these color selection periods ((1H/3)/4).

In the example illustrated in FIG. 9B, in the red selection period (high-period of the color selection signal SEL_R), the output timing switching signal SIG_SEL(1) is turned on in the period ((1H/3)/4) in which the gradation signal SIG_DP is at a positive voltage VHP1, whereby the second pixel signal SIG_DP(1) having a wave height value VHP1 is output.

In the example illustrated in FIG. 9B, in the green selection period (high-period of the color selection signal SEL_G), the output timing switching signal SIG_SEL(2) is turned on in the period ((1H/3)/4) in which the gradation signal SIG_DN is at a negative voltage VLN2, whereby the second pixel signal SIG_DN(2) having a wave height value VLN2 is output.

In the example illustrated in FIG. 9B, in the blue selection period (high-period of the color selection signal SEL_B), the output timing switching signal SIG_SEL(3) is turned on in the period ((1H/3)/4) in which the gradation signal SIG_DP is at a positive voltage VHP3, whereby the second pixel signal SIG_DP(3) having a wave height value VHP3 is output.

As described above, in the present embodiment, the gradation signals SIG_DP and SIG_DN are time-divisionally divided and sequentially output in each horizontal period 1H, whereby the output of the third switching unit 214 is controlled in the second display mode MODE2. In other words, in the present embodiment, the second display mode MODE2 can be operated using the gradation signals SIG_DP and SIG_DN output from the second amplifiers 212 that are smaller in number than the first amplifiers 211.

Figure 10:
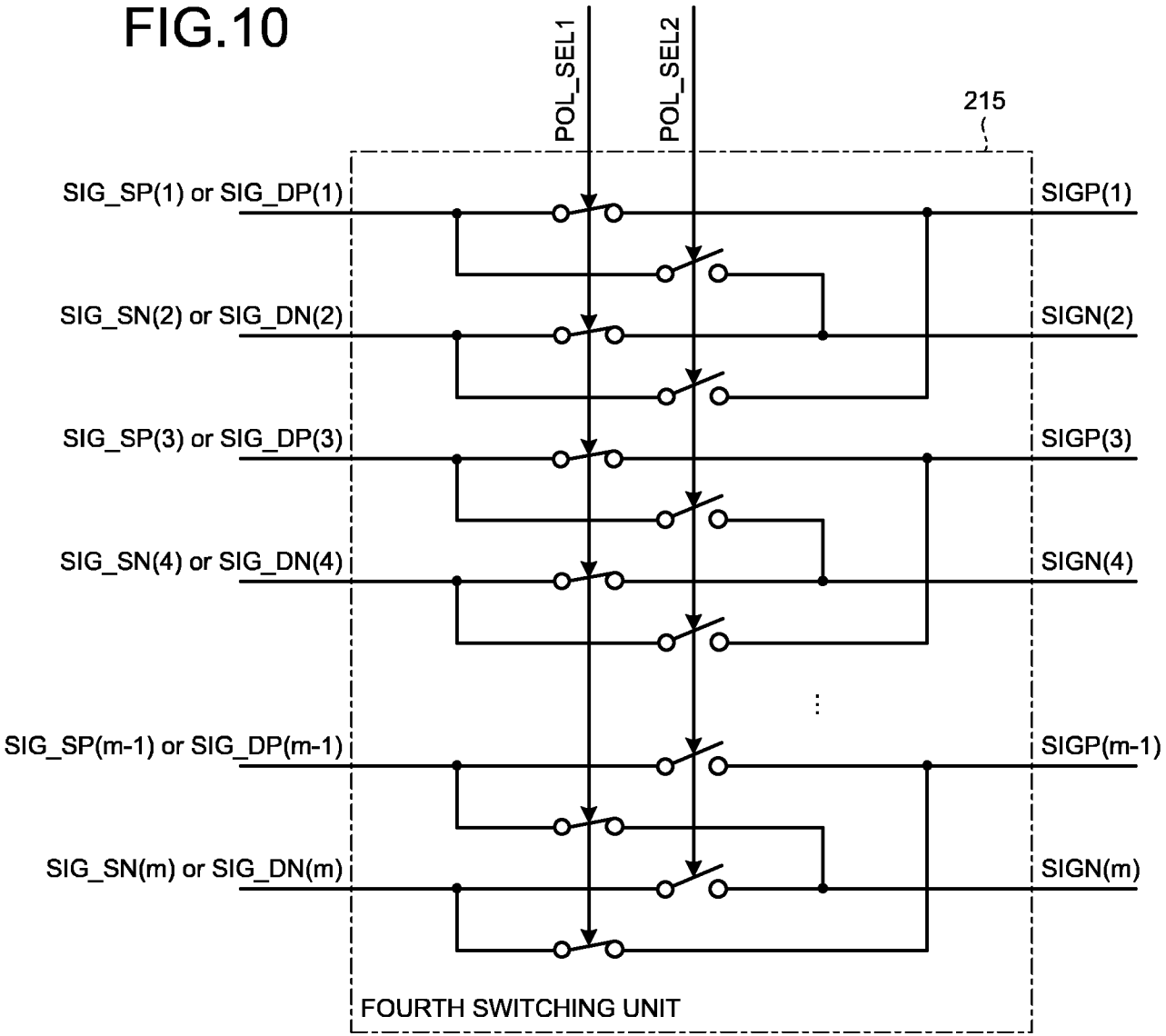
FIG. 10 is a diagram illustrating an example of a fourth switching unit.

FIG. 10 is a diagram illustrating an example of the fourth switching unit. The fourth switching unit 215 receives the first pixel signals SIG_SP(q) and SIG_SN(r) in the first display mode MODE1, and receives the second pixel signals SIG_DP(q) and SIG_DN(r) in the second display mode MODE2. The fourth switching unit 215 is switched in response to the first polarity signal POL_SEL1 and the second polarity signal POL_SEL2 received from the polarity reversing controller 2015. Hence, in the first display mode MODE1, the positive first pixel signals SIG_SP(q) and the negative first pixel signals SIG_SN(r) are appropriately switched therebetween in response to the first polarity signal POL_SEL1 and the second polarity signal POL_SEL2, and are output as pixel signals SIGP(q) and SIGP(r). In the second display mode MODE2, the positive second pixel signals SIG_DP(q) and the negative second pixel signals SIG_DN(r) are appropriately switched therebetween in response to the first polarity signal POL_SEL1 and the second polarity signal POL_SEL2, and are output as the pixel signals SIGP(q) and SIGN(r). The example illustrated in FIG. 10 represents a state in which some switches are controlled to be on by the first polarity signal POL_SEL1 and the other switches are controlled to be off by the second polarity signal POL_SEL2.

Figure 11:
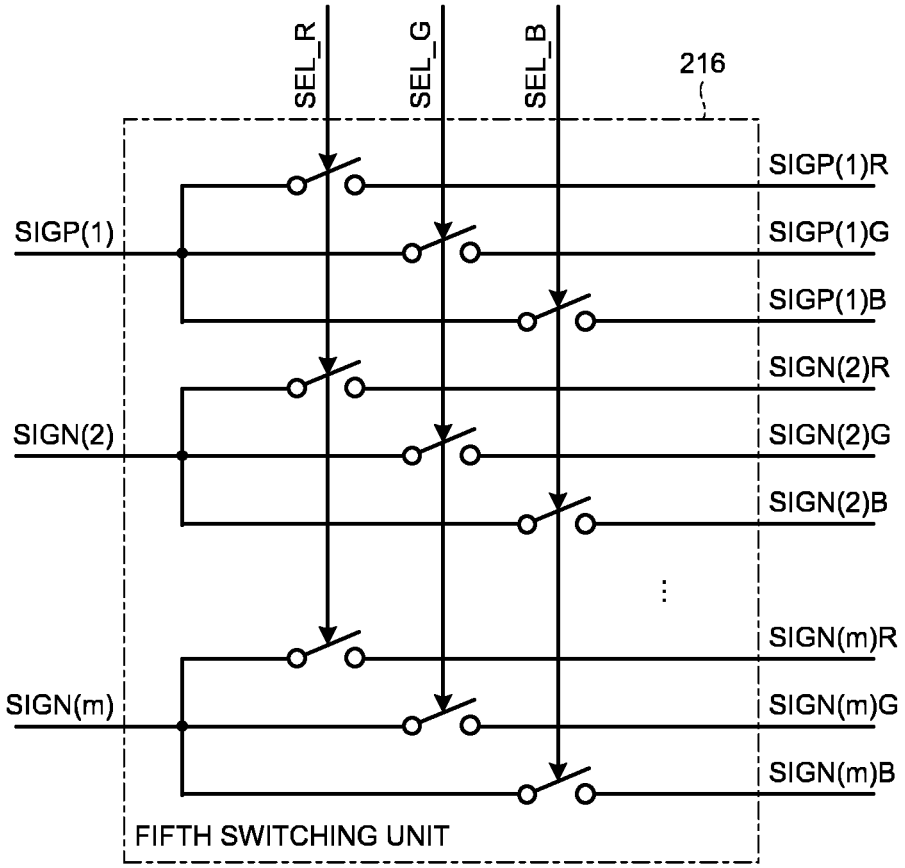
FIG. 11 is a diagram illustrating an example of a fifth switching unit.

FIG. 11 is a diagram illustrating an example of the fifth switching unit. As described above, the present embodiment is configured to transmit each of the sub-pixel signals by time-divisionally dividing each of the pixel signals SIGP(q) (or the pixel signals SIGN(r)) for corresponding one of the pixel columns. In other words, in the fifth switching unit 216, the received pixel signals SIGP(q) (or pixel signals SIGN(r)) are temporally divided by each of the color selection signals SEL_R, SEL_G, and SEL_B received from the color selection signal generator 2016, and sub-pixel signals SIGP(q)R, SIGP(q)G, and SIGP(q)B (or respective sub-pixel signals SIGN(r)R, SIGN(r)G, and SIGN(r)B) are output. The fifth switching unit 216 may have a configuration using, for example, low-temperature polycrystalline silicon (LTPS) TFTs or amorphous silicon (a-Si) TFTs formed on the image display panel 10.

The respective sub-pixel signals SIGP(q)R, SIGP(q)G, and SIGP(q)B (or the respective sub-pixel signals SIGN(r) R, SIGN(r)G, and SIGN(r)B) output from the fifth switching unit 216 are supplied to the signal lines DTL of the image display panel 10.

In the configuration described above, when the display is performed in the second display mode MODE2, the display is performed with the smaller number of gradations more than two gradations (for example, using the 6-bit signal having four gradations for each of the colors using the 2 higher-order bits of the 8 bits for each color of red, green, and blue). This display method enables more colorful color representation than that of the display with two gradations for each color of red, green, and blue. The second display mode MODE2 can omit the compression processing by the encoder 202 and the expansion processing by the decoder 206 that are required when the 24-bit signal is displayed in the first display mode MODE1. The second display mode MODE2 can stop the power supply to the first amplifiers 211 that is required when the display is performed in the first display mode MODE1. Therefore, when a power-saving full-time display function is used in the information terminal apparatus, such as the smartphone, with the display device 100 mounted thereon, both the multi-color display and the power reduction can be achieved by applying the second display mode MODE2 during the power-saving full-time display.

In the above-described example, when the display is performed in the second display mode MODE2, the display is performed with the smaller number of gradations more than two gradations. However, when the display is performed in the second display mode MODE2, the display may be performed with two gradations for each color of red, green, and blue.

Figure 12:
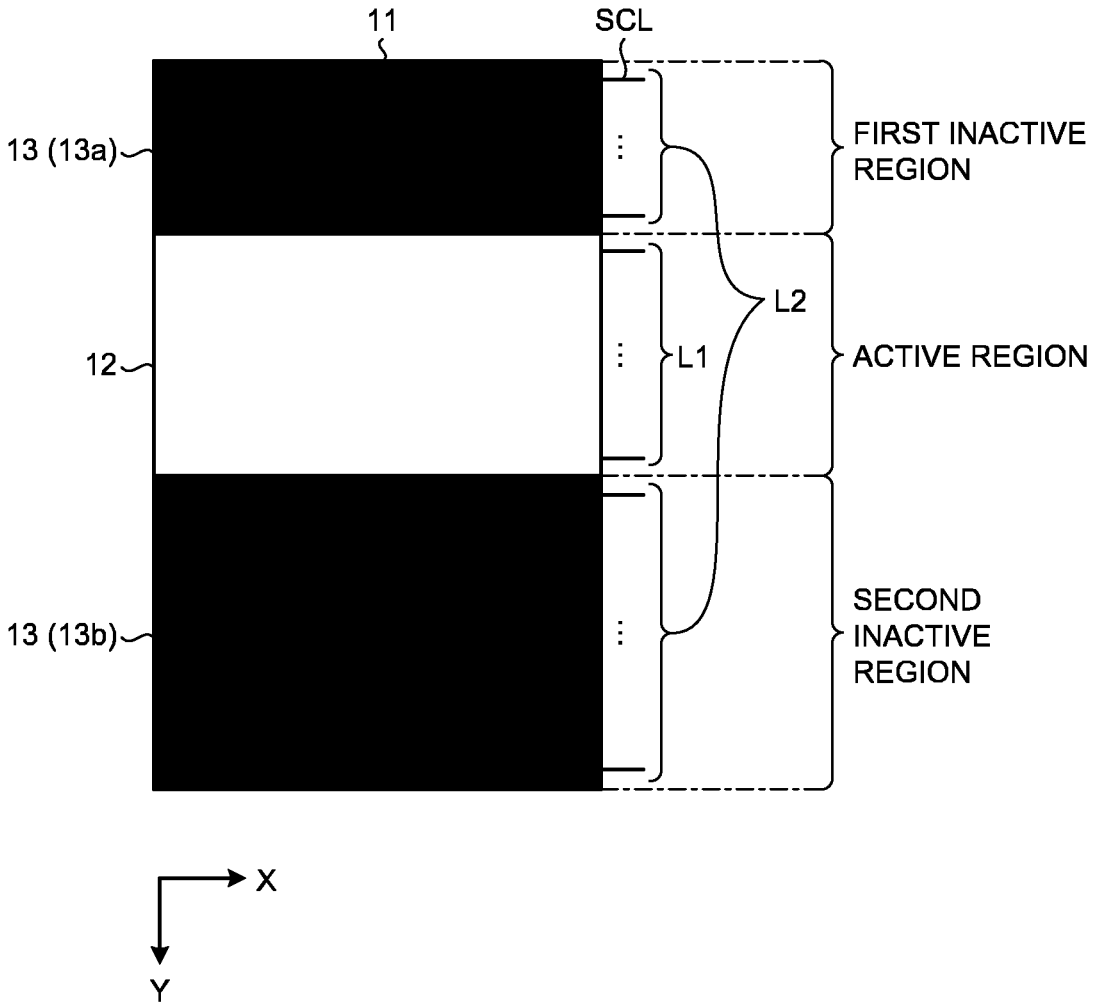
FIG. 12 is a diagram illustrating exemplary regions in which the image display is performed in the second display mode.

FIG. 12 is a diagram illustrating exemplary regions in which the image display is performed in the second display mode.

In the present embodiment, a region in a predetermined range in the scanning direction of the image display panel 10 is defined as an active region 12 for displaying the image of the video signal PSIG in the second display mode MODE2, and regions outside the active region 12 are referred to as inactive regions 13 for displaying all-black images in the second display mode MODE2. In the example illustrated in FIG. 12, a region above the active region 12 is defined as a first inactive region 13*a*, and a region below the active region 12 is defined as a second inactive region 13*b*. In the example illustrated in FIG. 12, L1 denotes the number of some of the scan lines SCL belonging to the active region 12, and L2 denotes the number of the others of the scan lines belonging to the first inactive region 13*a* and the second inactive region 13*b*. In other words, an active period of scanning of the active region 12 includes L1 horizontal periods, and an inactive period of scanning of the inactive regions 13 (the first inactive region 13*a* and the second inactive region 13*b*) includes L2 horizontal periods.

In the case of the display in the first display mode MODE1, a period of applying a sub-pixel signal to each of the sub-pixels SPix is substantially equal to the on-period of each of the color selection signals SEL_R, SEL_G, and SEL_B. As illustrated in the FIG. 4, the on-period of each of the color selection signals SEL_R, SEL_G, and SEL_B is equal to one-third of the horizontal period 1H (1H/3).

In contrast, in the case of the display in the second display mode MODE2, the period of applying the sub-pixel signal to each of the sub-pixels SPix is substantially equal to an on-period of each of the voltage selection signals CLK_V1, CLK_V2, CLK_V3, and CLK_V4. As illustrated in FIG. 4, the on-period of each of the voltage selection signals CLK_V1, CLK_V2, CLK_V3, and CLK_V4 is equal to one-quarter ((1H/3)/4) of the on-period (1H/3) of each of the color selection signals SEL_R, SEL_G, and SEL_B. That is, in the case of the display in the second display mode MODE2, the period of applying the sub-pixel signal to each of the sub-pixels SPix is a quarter that of the case of the display in the first display mode MODE1. Thus, time for charging the pixel capacitor CS of the sub-pixel SPix can be insufficient.

As illustrated in FIG. 3, in the present embodiment, the frequency of a main clock signal MCLK2 in the case of the display in the second display mode MODE2 is set lower than the frequency of a main clock signal MCLK1 in the case of the display in the first display mode MODE1. Specifically, the frequency of the main clock signal MCLK2 in the case of the display in the second display mode MODE2 is set to one-half of the frequency of the main clock signal MCLK1 in the case of the display in the first display mode MODE1. In other words, the period of the main clock signal MCLK2 in the case of the display in the second display mode MODE2 is set to twice the period of the main clock signal MCLK1 in the case of the display in the first display mode MODE1. As a result, the time for charging the pixel capacitors CS of the pixels PX in the active region 12 in the case of the display in the second display mode MODE2 is half that of the case of the display in the first display mode MODE1.

In addition, in the present embodiment, in the case of the display in the second display mode MODE2, the horizontal period of the active period of scanning of the active region 12 is set longer than the horizontal period of the inactive period of scanning of the inactive regions 13 (the first inactive region 13*a* and the second inactive region 13*b*). Specifically, in the case of the display in the second display mode MODE2, the horizontal period of the active period is set to twice that of a case where the horizontal period is equal for all periods of scanning of the display area 11. At this time, the active period is twice that of the case where the horizontal period is equal for all periods of scanning of the display area 11. The horizontal period of the inactive period is set to half that of the case where the horizontal period is equal for all periods of scanning of the display area 11. At this time, the inactive period is half that of the case where the horizontal period is equal for all periods of scanning of the display area 11. As a result, the time for charging the pixel capacitors CS of the sub-pixels SPix in the active region 12 in the case of the display in the second display mode MODE2 is made substantially equal to that of the case of the display in the first display mode MODE1. The horizontal period of the active period in the case of the display in the second display mode MODE2 may be, for example, three or four times that of the case where the horizontal period is equal for all periods of scanning of the display area 11, and need not be an integer multiple thereof. The horizontal period of the active period in the case of the display in the second display mode MODE2 is not limited to twice that of the case where the horizontal period is equal for all periods of scanning of the display area 11.

Figure 13:
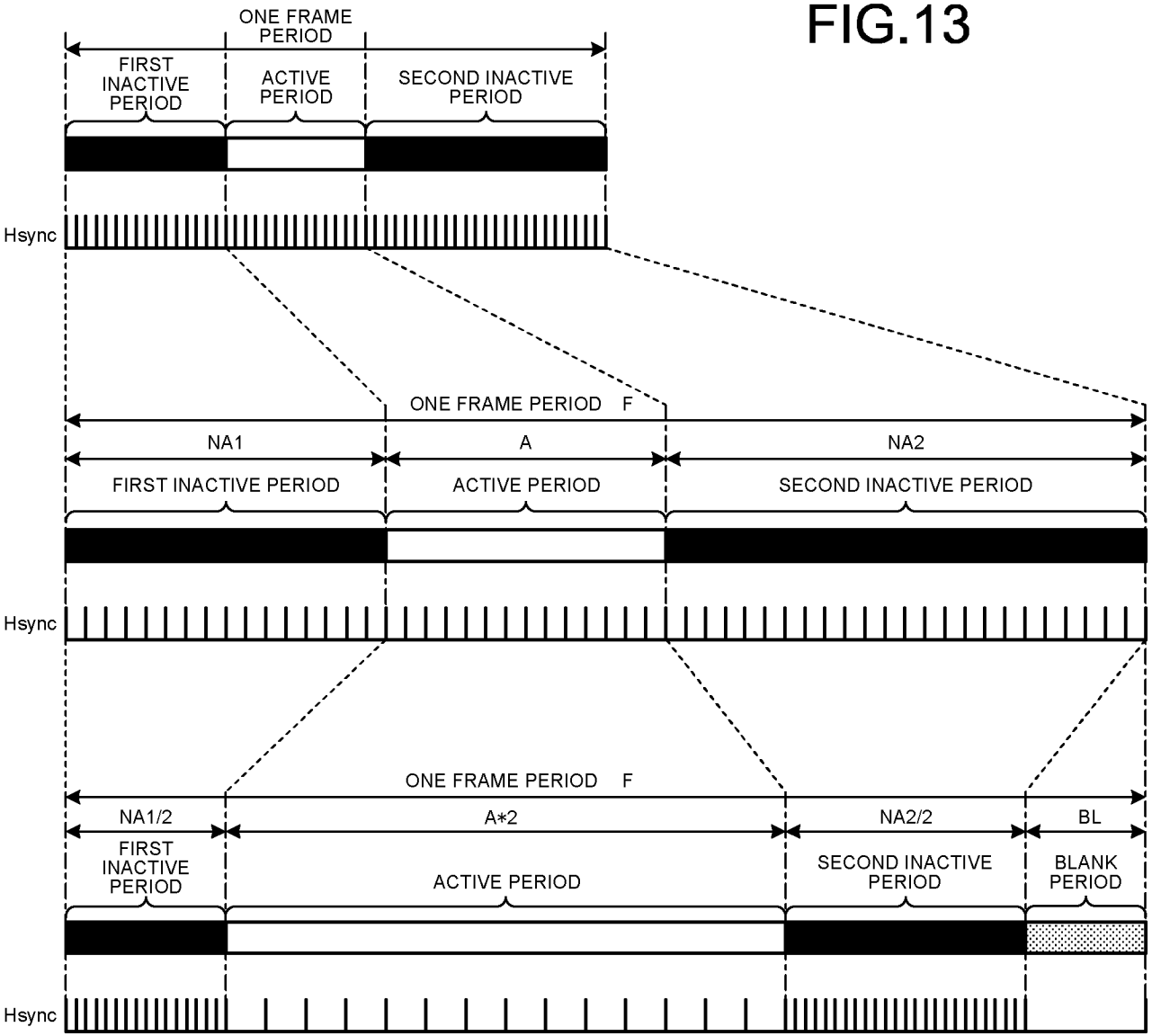
FIG. 13 is a diagram illustrating a first example of frame-by-frame allocation of periods when the display is performed in the second display mode.
Figure 14:
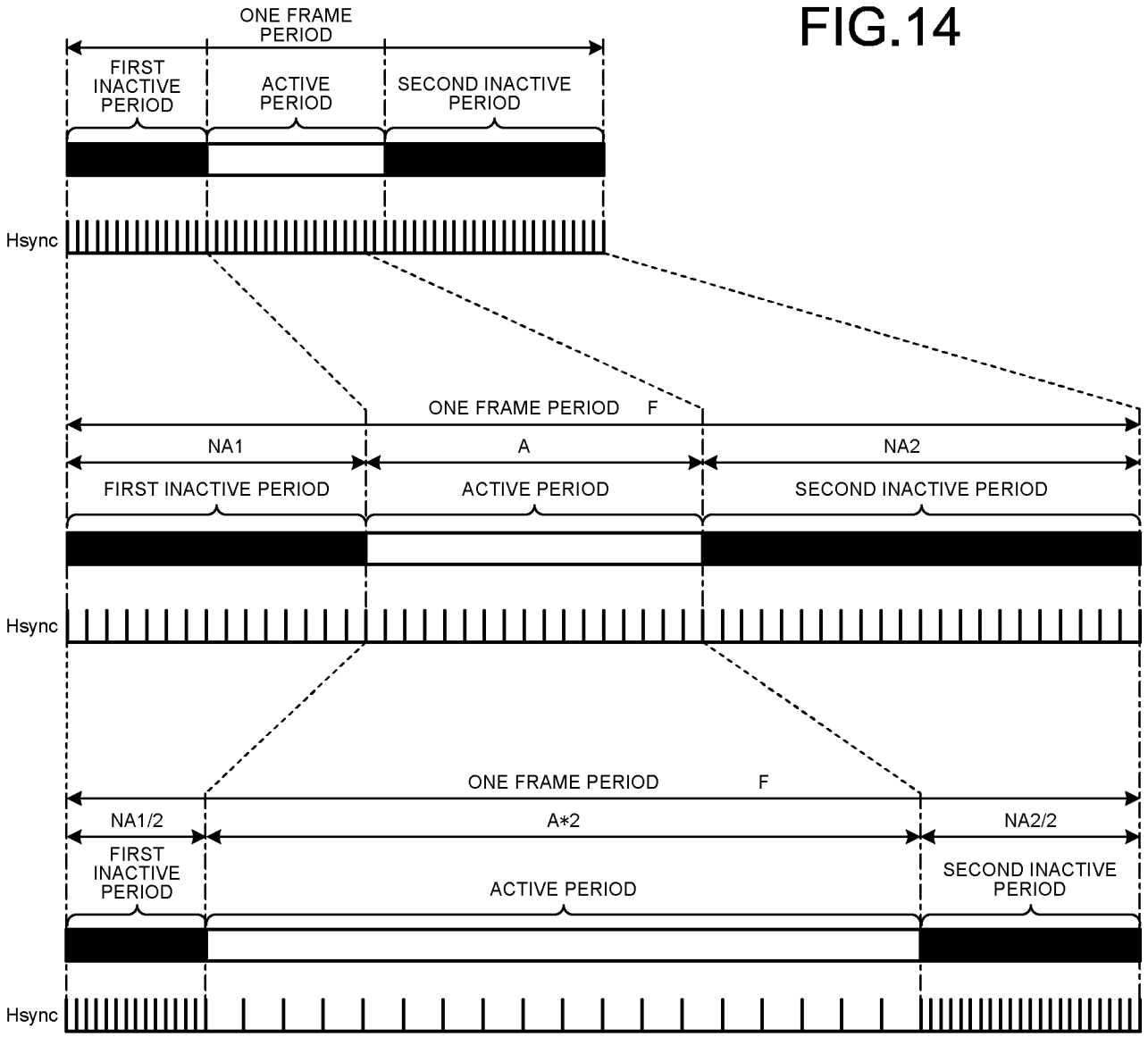
FIG. 14 is a diagram illustrating a second example of the frame-by-frame allocation of periods when the display is performed in the second display mode.
Figure 15:
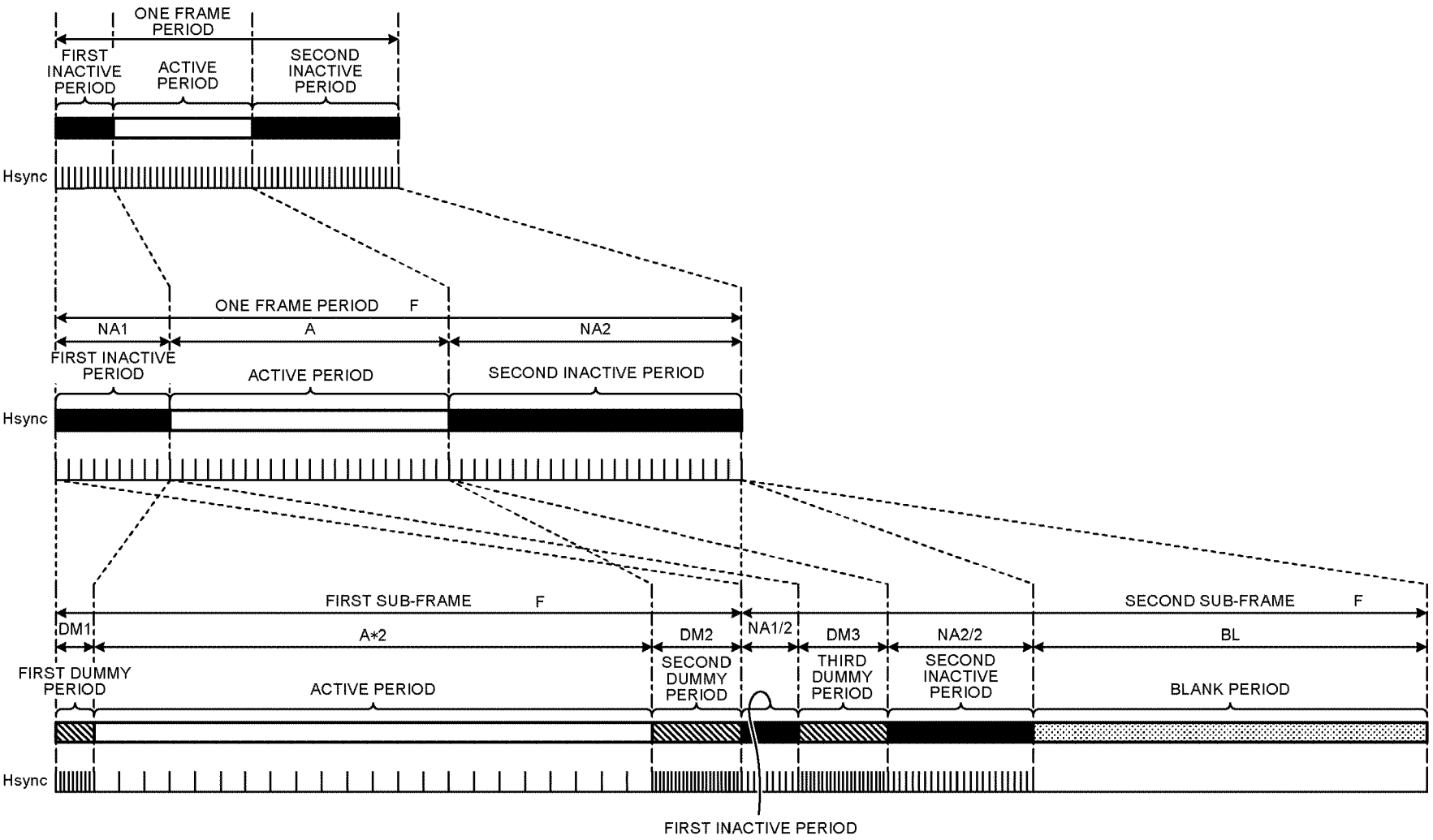
FIG. 15 is a diagram illustrating a third example of the frame-by-frame allocation of periods when the display is performed in the second display mode.
Figure 16:
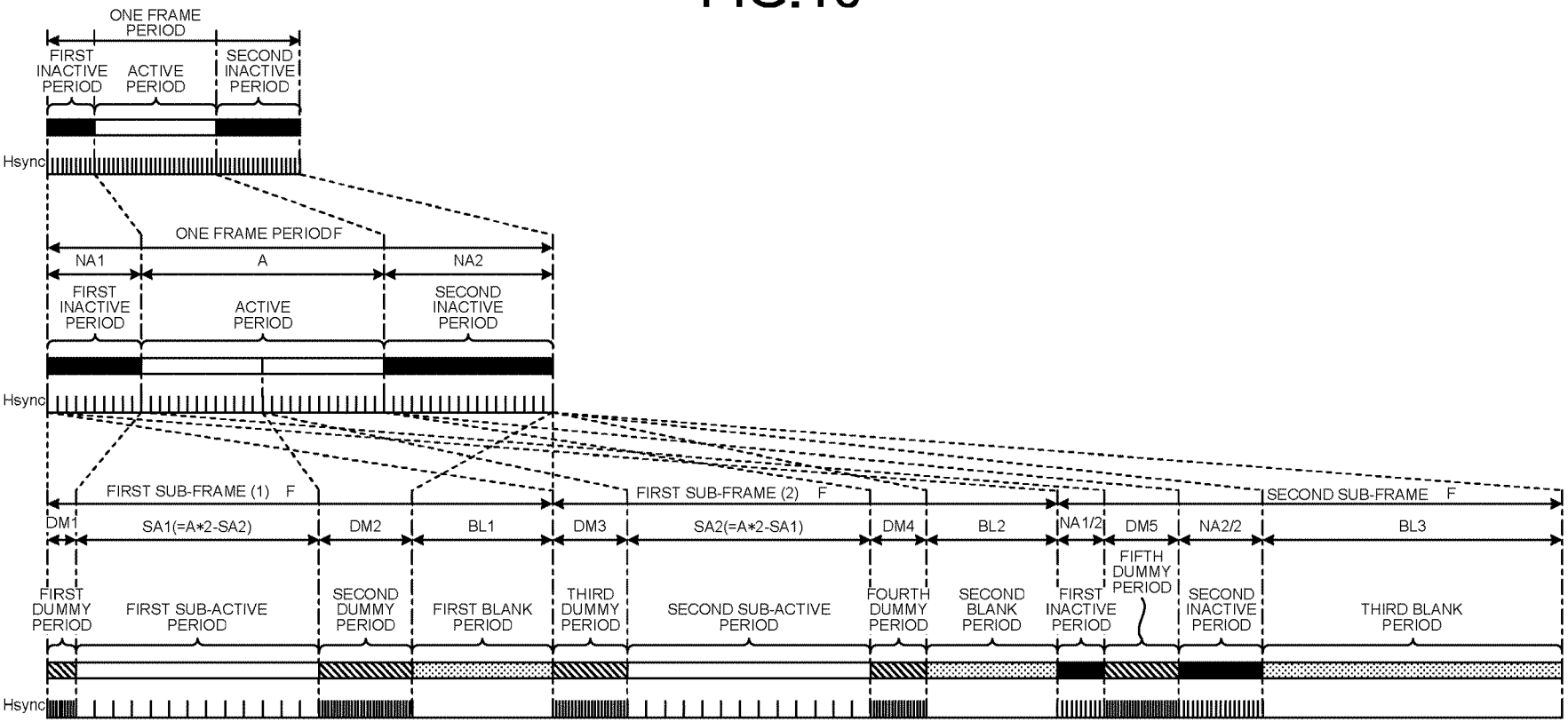
FIG. 16 is a diagram illustrating a fourth example of the frame-by-frame allocation of periods when the display is performed in the second display mode.
Figure 17:
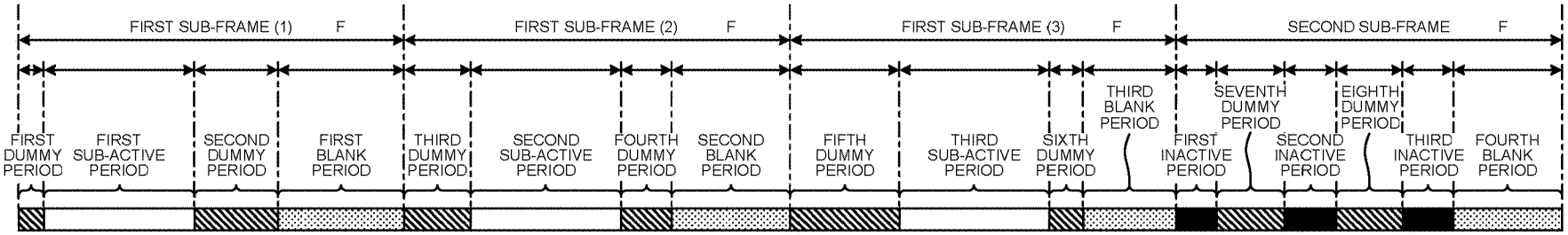
FIG. 17 is a diagram illustrating a fifth example of the frame-by-frame allocation of periods when the display is performed in the second display mode.

FIG. 13 is a diagram illustrating a first example of frame-by-frame allocation of periods when the display is performed in the second display mode. FIG. 14 is a diagram illustrating a second example of the frame-by-frame allocation of periods when the display is performed in the second display mode. FIG. 15 is a diagram illustrating a third example of the frame-by-frame allocation of periods when the display is performed in the second display mode. FIG. 16 is a diagram illustrating a fourth example of the frame-by-frame allocation of periods when the display is performed in the second display mode. FIG. 17 is a diagram illustrating a fifth example of the frame-by-frame allocation of periods when the display is performed in the second display mode. In the examples illustrated in FIGS. 13 to 17, a period of scanning of the first inactive region 13*a* is referred to as a first inactive period, and a period of scanning of the second inactive region 13*b* is referred to as a second inactive period.

FIG. 13 illustrates an active period A in the case where the horizontal period is equal for all periods of scanning of the display area 11. If the active period A is equal to or shorter than one-third of one frame period 1F ($A \leq (1/3)*F$), the total period of a first inactive period NA1/2, an active period A*2, and a second inactive period NA2/2 is equal to or shorter the one frame period 1F ($F \geq (NA1/2)+A*2+(NA2/2)$).

FIG. 14 illustrates the active period A in the case where the horizontal period is equal for all periods of scanning of the display area 11. If the active period A is equal to one-third of the one frame period 1F ($A=(1/3)*F$), the total period of the first inactive period NA1/2, the active period A*2, and the second inactive period NA2/2 is substantially equal to the one frame period 1F ($F=(NA1/2)+A*2+(NA2/2)$).

If, as illustrated in FIG. 13, the total period of the first inactive period NA1/2, the active period A*2, and the second inactive period NA2/2 is equal to or shorter the one frame period 1F ($F \geq (NA1/2)+A*2+(NA2/2)$), a blank period BL may be provided after the second inactive period NA2/2. Alternatively the horizontal periods in the first inactive period and the second inactive period may be finely adjusted (lengthened) to make the total period of the first inactive period NA1/2, the active period A*2, and the second inactive period NA2/2 substantially equal to the one frame period 1F.

In contrast, FIG. 15 illustrates the active period A in the case where the horizontal period is equal for all periods of scanning of the display area 11. If the active period A is longer than one-third of the one frame period 1F ((1/3)*F<A≤F), the total period of the first inactive period NA1/2, the active period A*2, and the second inactive period NA2/2 is longer than the one frame period 1F (F<(NA1/2)+A*2+(NA2/2)).

In this case, as illustrated in FIG. 15, an image for one frame is temporally divided into a plurality of sub-frames, and displayed. Specifically, the image for one frame is temporally divided into a first sub-frame including the active period A*2 and a second sub-frame including the inactive periods (the first inactive period NA1/2 and the second inactive period NA2/2). Hereinafter, the first sub-frame and the second sub-frame will each be simply called a sub-frame when need not be distinguished from each other.

In the example illustrated in FIG. 15, dummy periods are provided in which the horizontal scanning is performed while stopping the output of the pixel signals. Specifically, the first sub-frame includes a first dummy period DM1 including the same number of horizontal periods as that of the first inactive period NA1/2, the active period A*2, and a second dummy period DM2 including the same number of horizontal periods as that of the second inactive period NA2/2.

The second sub-frame includes the first inactive period NA1/2, a third dummy period DM3 including the same number of horizontal periods as that of the active period A*2, the second inactive period NA2/2, and the blank period BL.

The blank period BL may be provided after the second inactive period NA2/2 as illustrated in FIG. 15, or the horizontal periods in the third dummy period DM3 may be adjusted (lengthened) to make the second sub-frame substantially equal in length to the one frame period 1F.

The horizontal periods in the first dummy period DM1, the second dummy period DM2, and the third dummy period DM3 are limited by the period of the main clock signal MCLK. That is, in the third example illustrated in FIG. 15, the total period of a period obtained by multiplying the period of the main clock signal MCLK by L2 (total of horizontal periods of the first inactive period NA1/2 and horizontal periods of the second inactive period NA2/2) and the active period A*2 needs to be equal to or shorter than the one frame period 1F (F≥(MCLK period)*L2+A*2).

If the total period of the period obtained by multiplying the period of the main clock signal MCLK by L2 (total of horizontal periods of the first inactive period NA1/2 and horizontal periods of the second inactive period NA2/2) and the active period A*2 is longer than the one frame period 1F (F<(MCLK period)*L2+A*2), a plurality of sub-active periods are provided by temporally dividing the active period for performing the image display in the active region 12, and the first sub-frames including the respective sub-active periods are provided, as illustrated in FIG. 16.

In the example illustrated in FIG. 16, the active period A*2 is temporally divided into a first sub-active period SA1 and a second sub-active period SA2.

The first sub-frame (1) includes the first dummy period DM1, the first sub-active period SA1 (=A*2−SA2), the second dummy period DM2, and a first blank period BL1. The first dummy period DM1 includes the same number of horizontal periods as that of the first inactive period NA1/2. The second dummy period DM2 includes the same number of horizontal periods as that of the total of the horizontal periods of the second sub-active period SA2 and the horizontal periods of the second inactive period NA2/2.

The first sub-frame (2) includes the third dummy period DM3, the second sub-active period SA2 (=A*2−SA1), a fourth dummy period DM4, and a second blank period BL2. The third dummy period DM3 includes the same number of horizontal periods as that of the total of the horizontal periods of the first inactive period NA1/2 and the horizontal periods of the first sub-active period SAL A fourth dummy period DM4 includes the same number of horizontal periods as that of the second inactive period NA2/2.

The second sub-frame includes the first inactive period NA1/2, a fifth dummy period DM5 including the same number of horizontal periods as that of the active period A*2, the second inactive period NA2/2, and a third blank period BL3.

The first blank period BL1 may be provided after the second dummy period as illustrated in FIG. 16, or the horizontal periods in the first dummy period DM1 and the second dummy period DM2 may be adjusted (lengthened) to make the first sub-frame including the first sub-active period SA1 substantially equal in length to the one frame period 1F.

The second blank period BL2 may be provided after the fourth dummy period DM4 as illustrated in FIG. 16, or the horizontal periods in the third dummy period DM3 and the fourth dummy period DM4 may be adjusted (lengthened) to make the first sub-frame including the second sub-active period SA2 substantially equal in length to the one frame period 1F.

The third blank period BL3 may be provided after the second inactive period NA2/2 as illustrated in FIG. 16. Alternatively, the horizontal periods in the fifth dummy period DM5 may be adjusted (lengthened) to make the second sub-frame substantially equal in length to the one frame period 1F.

The number of the first sub-frames when the image for one frame is displayed is not limited to two, and may be three or larger.

The example illustrated in FIG. 17 represents an example in which the active period is temporally divided into the first sub-active period, the second sub-active period, and a third sub-active period. The details of each of the periods are the same as those of the example illustrated in FIG. 16, and therefore will not be described here.

Figure 18A:
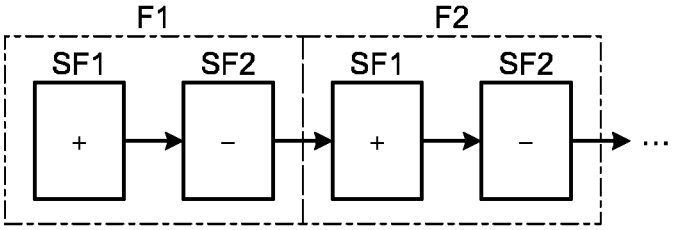
FIG. 18A is a diagram illustrating an example in which the total number of first sub-frames and second sub-frames is two, that is, an image for one frame is displayed using one of the first sub-frames and one of the second sub-frames in a display device.
Figure 18B:
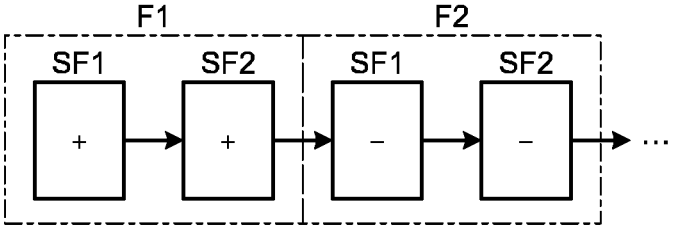
FIG. 18B is a diagram illustrating an example in which the total number of the first sub-frames and the second sub-frames is two, that is, the image for one frame is displayed using one of the first sub-frames and one of the second sub-frames in the display device according to the embodiment.
Figure 19:
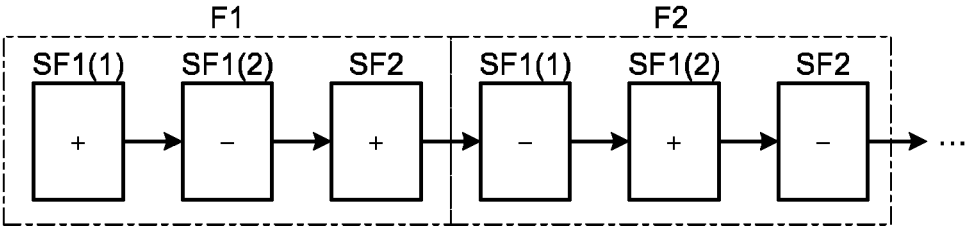
FIG. 19 is a diagram illustrating an example in which the total number of the first sub-frames and the second sub-frames is three, that is, the image for one frame is displayed using two of the first sub-frames and one of the second sub-frames in the display device according to the embodiment.

FIG. 18A is a diagram illustrating an example in which the total number of first sub-frames and second sub-frames is two, that is, the image for one frame is displayed using one of the first sub-frames and one of the second sub-frames in a display device. FIG. 18B is a diagram illustrating an example in which the total number of the first sub-frames and the second sub-frames is two, that is, the image for one frame is displayed using one of the first sub-frames and one of the second sub-frames in the display device according to the embodiment. FIG. 19 is a diagram illustrating an example in which the total number of the first sub-frames and the second sub-frames is three, that is, the image for one frame is displayed using two of the first sub-frames and one of the second sub-frames in the display device according to the embodiment. In the example illustrated in FIG. 19, one frame includes two first sub-frames SF1(1) and SF1(2). FIG.

20A is a diagram illustrating an example in which the total number of the first sub-frames and the second sub-frames is four, that is, the image for one frame is displayed using three of the first sub-frames and one of the second sub-frames in the display device. FIG. 20B is a diagram illustrating an example in which the total number of the first sub-frames and the second sub-frames is four, that is, the image for one frame is displayed using three of the first sub-frames and one of the second sub-frames in the display device according to the embodiment. In the examples illustrated in FIGS. 20A and 20B, one frame includes three first sub-frames SF1(1), SF1(2), and SF1(3).

In the examples illustrated in FIGS. 18A, 18B, 19, 20A, and 20B, "+" and "−" denote two states of polarity of each of the pixels that is relatively different between sub-frames.

As illustrated in FIG. 19, when the number of the sub-frames for displaying each frame (F1, F2, . . . ) is an odd number, the polarity of the signal to be supplied to each of the pixels PX is reversed on a sub-frame-by-sub-frame basis. This operation reverses the polarity of the signal to be supplied to each of the pixels PX between the first sub-frames SF1 corresponding to each other between a frame F1 and a frame F2. In other words, this operation reverses the polarity of the signal to be supplied to each of the pixels PX between the first sub-frame SF1(1) in the frame F1 and the first sub-frame SF1(1) in the frame 2 and between the first sub-frame SF1(2) in the frame F1 and the first sub-frame SF1(2) in the frame 2.

Figure 20A:
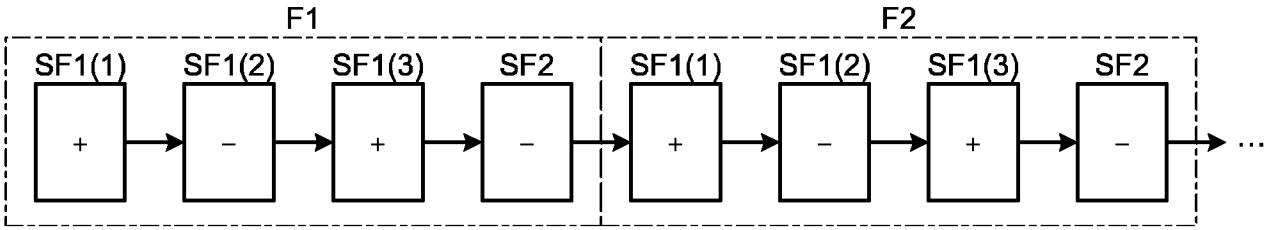
FIG. 20A is a diagram illustrating an example in which the total number of the first sub-frames and the second sub-frames is four, that is, the image for one frame is displayed using three of the first sub-frames and one of the second sub-frames in the display device.
Figure 20B:
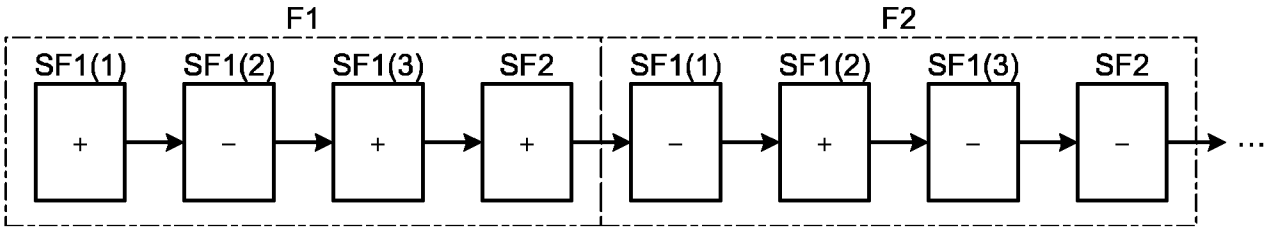
FIG. 20B is a diagram illustrating an example in which the total number of the first sub-frames and the second sub-frames is four, that is, the image for one frame is displayed using three of the first sub-frames and one of the second sub-frames in the display device according to the embodiment.

In contrast, as illustrated in FIGS. 18A and 20A, when the number of the sub-frames for displaying each frame (F1, F2, . . . ) is an even number, if the polarity of the signal to be supplied to each of the pixels PX is reversed on a sub-frame-by-sub-frame basis, the polarity of the signal to be supplied to each of the pixels PX does not change between the first sub-frames SF1 corresponding to each other between the frame F1 and the frame F2, that is, between the first sub-frame SF1(1) in the frame F1 and the first sub-frame SF1(1) in the frame F2, between the first sub-frame SF1(2) in the frame F1 and the first sub-frame SF1(2) in the frame F2, and between the first sub-frame SF1(3) in the frame F1 and the first sub-frame SF1(3) in the frame F2. Thus, the polarity held by each of the pixels PX in the active region 12 is biased to the positive polarity or the negative polarity, and can cause degradation, such as burn-in, of the image display panel 10.

Accordingly, in the present embodiment, as illustrated in FIGS. 18B and 20B, if the number of the sub-frames for displaying each frame (F1, F2, . . . ) is an even number, the polarity of the signal to be supplied to each of the pixels PX is reversed at times of transition between the first sub-frames and transition from the second sub-frame to the first sub-frame, and the polarity of the signal to be supplied to each of the pixels PX is not reversed at the time of transition from the first sub-frame to the second sub-frame. In this way, the polarity of the signal to be supplied to each of the pixels PX is reversed between the first sub-frames SF1 corresponding to each other between the frame F1 and the frame F2. Thus, the bias of the polarity held by each of the pixels PX in the active region 12 can be reduced.

Figure 21:
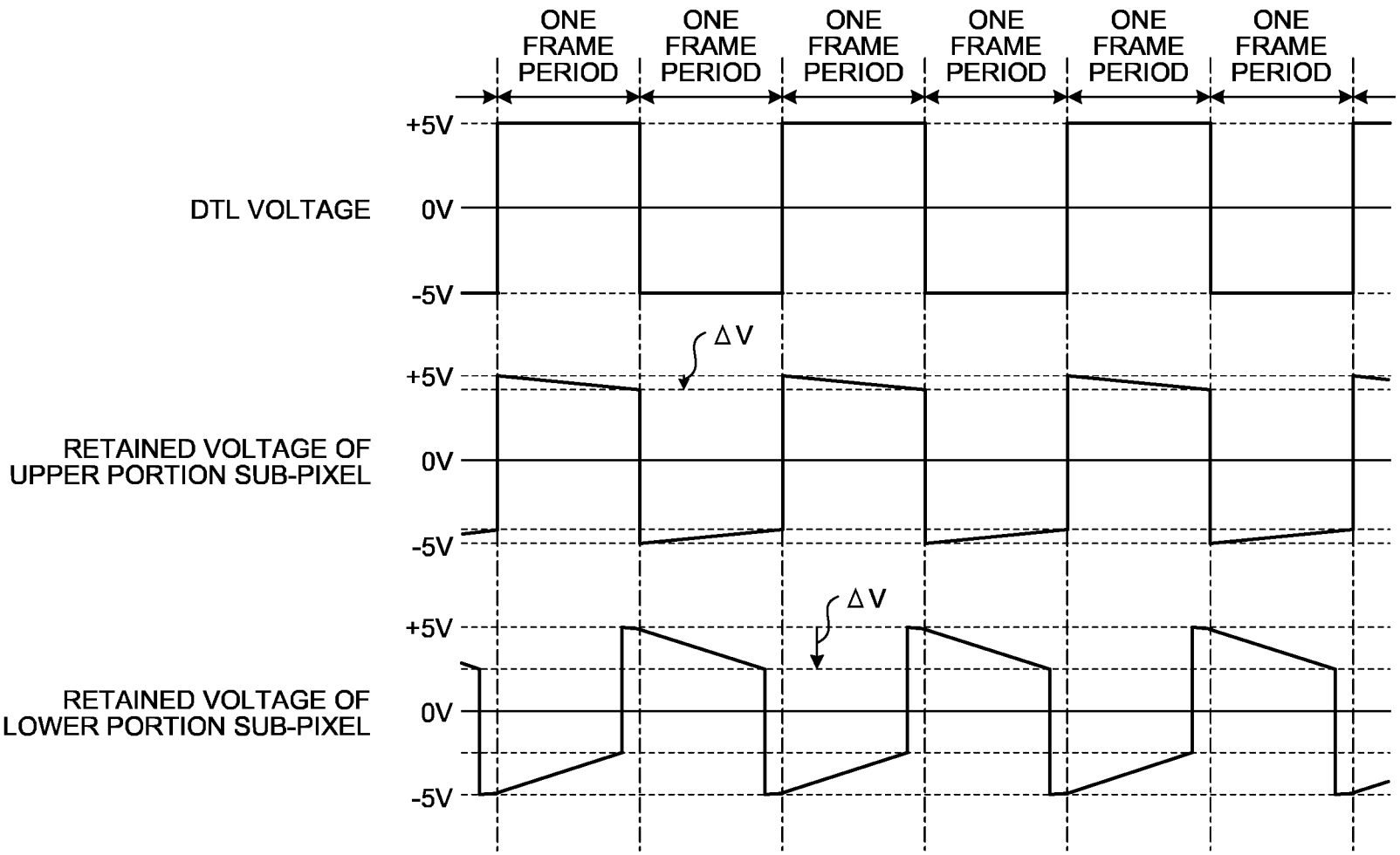
FIG. 21 is a diagram illustrating changes in retained voltages in two sub-pixels that are coupled to the same signal line and are located at an upper portion and a lower portion of an active region in the display device.
Figure 22:
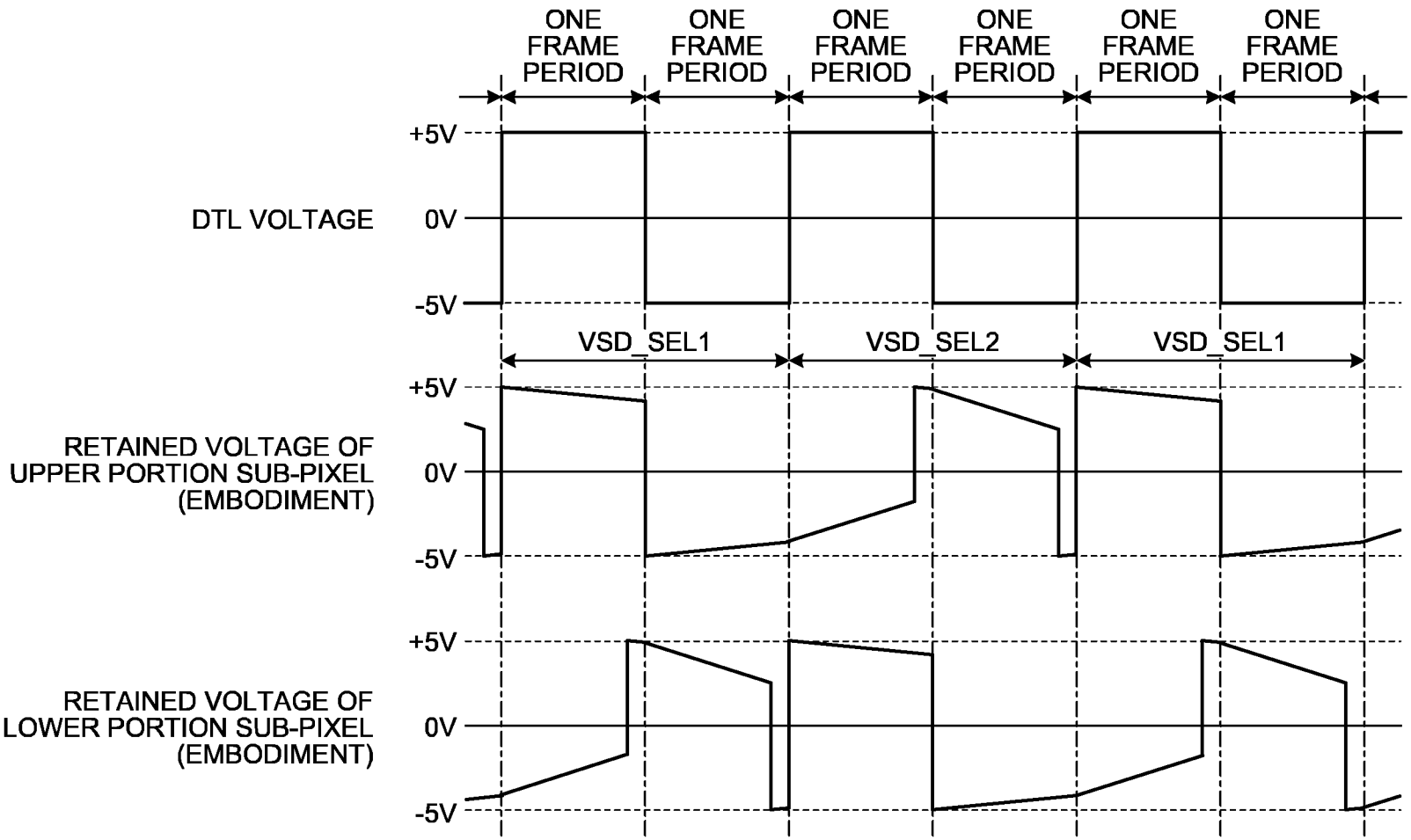
FIG. 22 is a diagram illustrating changes in the retained voltages in the two sub-pixels that are coupled to the same signal line and are located at the upper portion and the lower portion of the active region in the display device according to the embodiment.

FIG. 21 is a diagram illustrating changes in retained voltages in two sub-pixels that are coupled to the same signal line and are located at an upper portion and a lower portion of the active region in the display device. FIG. 22 is a diagram illustrating changes in the retained voltages in the two sub-pixels that are coupled to the same signal line and are located at the upper portion and the lower portion of the active region in the display device according to the embodiment. In the examples illustrated in FIGS. 21 and 22, the upper portion refers to a position on a relatively upper side in the display area 11 illustrated in FIG. 12, and the lower portion refers to a position on a relatively lower side in the display area 11 illustrated in FIG. 12.

Figure 23:
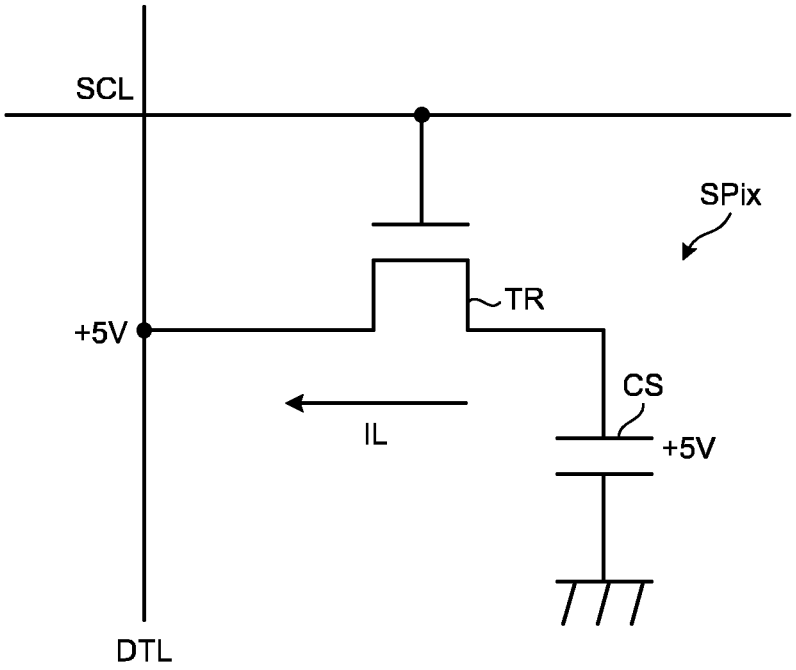
FIG. 23 is a diagram illustrating a level of a leakage current when a sub-pixel has a retained voltage of +5 V and a signal line has a potential of +5 V.
Figure 24:
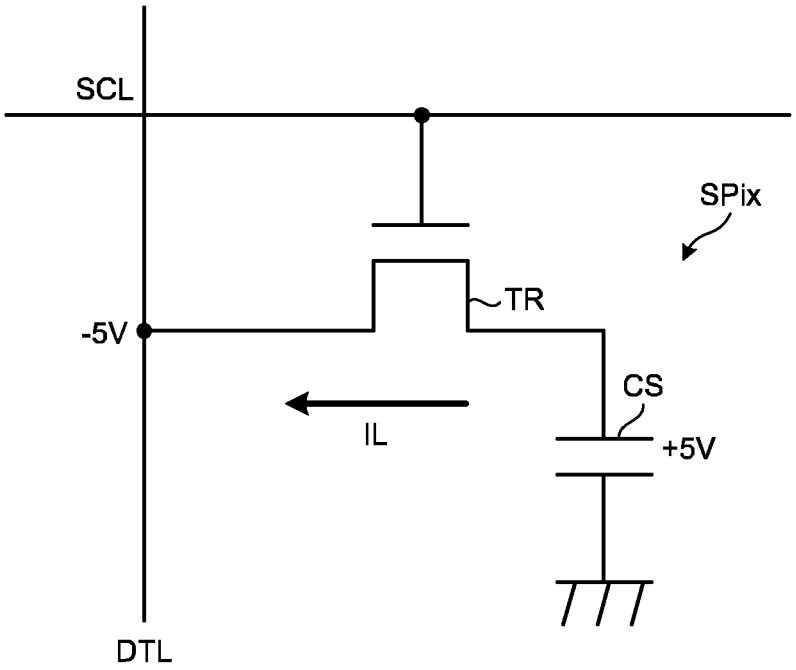
FIG. 24 is a diagram illustrating a level of the leakage current when the sub-pixel has the retained voltage of +5 V and the signal line has a potential of −5 V.

FIG. 23 is a diagram illustrating a level of a leakage current when a sub-pixel has a retained voltage of +5 V and the signal line has a potential of +5 V. FIG. 24 is a diagram illustrating a level of the leakage current when the sub-pixel has the retained voltage of +5 V and the signal line has a potential of −5 V.

As illustrated in FIGS. 23 and 24, as the potential difference between the retained voltage of the sub-pixel SPix and the voltage of the signal line DTL is larger, a leakage current IL flowing from the pixel capacitor CS through the pixel transistor TR is larger.

In the case of the sub-pixel SPix located in the upper portion of the active region 12, since the potential of the signal line DTL is maintained after writing is performed by the potential of the signal line DTL, a drop ΔV in retained voltage in the one frame period is smaller. In contrast, in the case of the sub-pixel SPix located in the lower portion of the active region 12, a shorter time elapses after the writing is performed by the potential of the signal line DTL until the potential of the signal line DTL is reversed, and the potential difference between the retained voltage of the sub-pixel SPix and the voltage of the signal line DTL is kept large for a longer time. Therefore, the drop ΔV in retained voltage in the one frame period is larger (refer to FIG. 21).

As described above, in the present embodiment, the frequency of the main clock signal MCLK2 in the case of the display in the second display mode MODE2 is set lower than the frequency of the main clock signal MCLK1 in the case of the display in the first display mode MODE1. Specifically, the frequency of the main clock signal MCLK2 in the case of the display in the second display mode MODE2 is half that of the main clock signal MCLK1 in the case of the display in the first display mode MODE1. Consequently, the length of the one frame period is longer in the case of the display in the second display mode MODE2 than in the case of the display in the first display mode MODE1. As a result, the drop ΔV in retained voltage of the sub-pixel SPix in the one frame period is larger than that in the case of the display in the first display mode MODE1. In particular, in the case of the sub-pixel SPix located in the lower portion of the active region 12, the drop ΔV in retained voltage in the one frame period is larger. Consequently, flickers occurring in the frame period can be more easily visible in the lower portion of the active region 12.

Accordingly, in the present embodiment, the direction of scanning of the scan lines DTL is reversed every two frames in the case of the display in the second display mode MODE2. Specifically, the scan drive circuit 22 reverses the direction of scanning of the scan lines SCL based on the scanning direction signal VSD_SEL output from the scan drive direction controller 2014 of the timing controller 2010. The read controller 205 reverses the direction of reading of data for one frame from the data holder 204 based on the scanning direction signal VSD_SEL.

Figure 25:
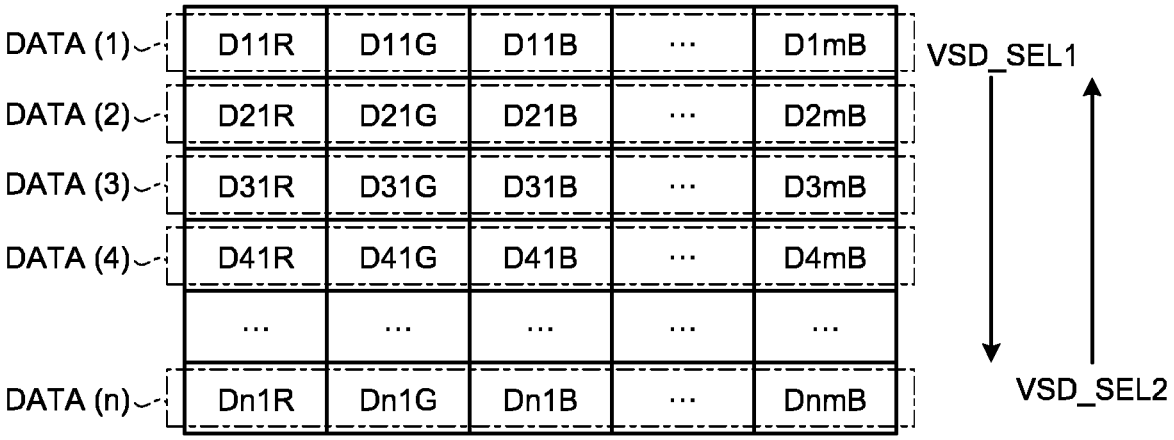
FIG. 25 is a diagram illustrating a specific example of reversing the direction of reading of data stored in a data holder.

FIG. 25 is a diagram illustrating a specific example of reversing the direction of the reading of the data stored in the data holder.

After receiving a scanning direction signal VSD_SEL1, the read controller 205 reads the data stored in the data holder 204 in the order of DATA(1), DATA(2), DATA(3), DATA(4), . . . , DATA(n). After receiving a scanning direction signal VSD_SEL2, the read controller 205 reads the data stored in the data holder 204 in the order of DATA(n), . . . , DATA(4), DATA(3), DATA(2), DATA(1) (refer to FIG. 25).

After receiving the scanning direction signal VSD_SEL1, the scan drive circuit 22 outputs the scan signals GATE(1), GATE(2), GATE(3), GATE(4), . . . , GATE(n) in this order to the scan lines SCL. After receiving the scanning direction signal VSD_SEL2, the scan drive circuit 22 outputs the scan signals GATE(n), . . . , GATE(4), GATE(3), GATE(2), GATE(1) in this order to the scan lines SCL.

In this way, the direction of scanning of the scan lines DTL by the scan drive circuit 22 and the direction of reading of the data by the read controller 205 are simultaneously switched, and thus, the image display is performed in the second display mode MODE2. As a result, as illustrated in FIG. 22, the occurrence frequency of the increase of the drop in retained voltage is distributed every two frames to the upper portion and the lower portion of the active region 12, and the flickers become difficult to be visible.

As described above, the display device 100 according to the present embodiment includes the image display panel 10 including the pixels PX that each include the sub-pixels SPix for displaying different colors and that are arranged in a matrix, the scan lines SCL coupled to the respective sub-pixels SPix arranged in the row direction, and the signal lines DTL coupled to the respective sub-pixels SPix arranged in the column direction, and the image display panel driver 20 that is supplied with the video signal PSIG having a predetermined number of gradations and that drives the image display panel 10, and the display device 100 has the first display mode MODE1 for performing the display with the number of gradations of the video signal PSIG and the second display mode MODE2 for performing the display with the number of gradations smaller than that of the video signal PSIG and larger than two. The image display panel driver 20 includes the first amplifiers 211 that amplify, in the first display mode MODE1, the signals to be supplied to the respective pixels PX arranged in the column direction, the second amplifiers 212 that are smaller in number than the first amplifiers 211 and that amplify, in the second display mode MODE2, the gradation signals obtained by time-divisionally dividing the several types of voltages corresponding to the number of displayed gradations in one horizontal period, and the second switching unit 213 that switches between the outputs of the first amplifiers 211 and the outputs of the second amplifiers 212 and outputs the selected outputs to the signal lines DTL, and the image display panel driver 20 controls the output timing of the second amplifiers 212 according to the video signal PSIG in the second display mode MODE2.

In other words, the image display panel driver 20 supplies the signals having first gradations in the first display mode MODE1, and supplies the signals having second gradations smaller in number than the first gradations in the second display mode MODE2, to the respective pixels PX arranged in the column direction.

In the configuration described above, when the display is performed in the second display mode MODE2, the display is performed with the smaller number of gradations more than two gradations (for example, using the 6-bit signal having four gradations for each of the colors using the 2 higher-order bits of the 8 bits for each color of red, green, and blue). This display method enables more colorful color representation than that of the display with two gradations for each color of red, green, and blue to be performed. In the second display mode MODE2, since the data volume is reduced, the compression processing and the expansion processing can be omitted. The second display mode MODE2 can stop the power supply to the first amplifiers 211 that is required when the display is performed in the first display mode MODE1. Therefore, when the power-saving full-time display is performed in the information terminal apparatus, such as the smartphone, with the display device 100 mounted thereon, both the multi-color display and the power reduction can be achieved by applying the second display mode MODE2 during the power-saving full-time display.

The frequency of the main clock signal MCLK2 in the case of the display in the second display mode MODE2 is set lower than the frequency of the main clock signal MCLK1 in the case of the display in the first display mode MODE1. Specifically, the frequency of the main clock signal MCLK2 in the case of the display in the second display mode MODE2 is half that of the main clock signal MCLK1 in the case of the display in the first display mode MODE1.

In addition, in the case of the display in the second display mode MODE2, the horizontal period of the active period of scanning of the active region 12 is set longer than the horizontal period of the inactive period of scanning of the inactive regions 13 (the first inactive region 13*a* and the second inactive region 13*b*). Specifically, in the case of the display in the second display mode MODE2, the horizontal period of the active period is set to twice that of the case where the horizontal period is equal for all periods of scanning of the display area 11.

As a result, the time can be ensured for charging the pixel capacitors CS of the sub-pixels SPix in the active region 12 in the case of the display in the second display mode MODE2.

The frequency of the main clock signal MCLK2 in the case of the display in the second display mode MODE2 is set lower than the frequency of the main clock signal MCLK1 in the case of the display in the first display mode MODE1, whereby the power-saving full-time display using the second display mode MODE2 can be performed at still lower power.

The present embodiment can provide the display device 100 capable of operating at lower power while performing the multi-color display during the power-saving full-time display.

The components of the embodiment described above can be combined as appropriate. Other operational advantages accruing from the aspects described in the present embodiment that are obvious from the description herein, or that are appropriately conceivable by those skilled in the art will naturally be understood as accruing from the present disclosure.

What is claimed is:

1. A display device comprising:

an image display panel comprising a plurality of pixels that each comprise a plurality of sub-pixels to display different colors and that are arranged in a matrix, a plurality of scan lines coupled to the respective sub-pixels arranged in a row direction, and a plurality of signal lines coupled to the respective sub-pixels arranged in a column direction; and a driver configured to be supplied with a video signal having a predetermined number of gradations and configured to drive the image display panel, and having:

a first display mode of performing display with the number of gradations of the video signal; and a second display mode of performing the display with a number of gradations smaller than the number of gradations of the video signal and larger than two, wherein the driver comprises:

a plurality of first amplifiers configured to amplify, in the first display mode, signals to be supplied to the respective pixels arranged in the column direction;

second amplifiers that are smaller in number than the first amplifiers and that are configured to amplify, in the second display mode, gradation signals obtained by temporally dividing several types of voltages corresponding to a number of displayed gradations in one horizontal period; and a switching unit configured to switch between outputs of the first amplifiers and outputs of the second amplifiers to output the selected outputs to the signal lines, wherein the second amplifiers have lower power consumption than the first amplifiers, the driver is configured to define a region in a predetermined range in a scanning direction of the image display panel as an active region to display an image of the video signal in the second display mode, and is configured to define a region outside the active region as an inactive region to display an all-black image in the second display mode, the driver is configured to set the horizontal period of an active period of scanning the active region longer than the horizontal period of an inactive period of scanning of the inactive region, the driver is configured to temporally divide an image for one frame into a plurality of sub-frames and display the divided image when a total period of the active period and the inactive period is equal to or longer than one frame period, when temporally dividing the image for one frame into the sub-frames and displaying the divided image, the driver is configured to temporally divide the image for one frame into at least one first sub-frame including the active period and one second sub-frame including the inactive period, and each of the first sub-frame and the second sub-frame includes a dummy period in which horizontal scanning is performed while stopping the outputs of the second amplifiers.

2. The display device according to claim 1, wherein the switching unit is configured to:

switch to the outputs of the first amplifiers in the first display mode; and switch to the outputs of the second amplifiers in the second display mode, and the driver comprises an output timing controller configured to control output timing of the second amplifiers according to the video signal.

3. The display device according to claim 1, wherein the driver comprises a power supply circuit configured to supply power to at least the first amplifiers, and the power supply circuit is configured to stop supplying the power to the first amplifiers in the second display mode.

4. The display device according to claim 1, wherein the driver comprises a reference clock generator configured to generate a main clock signal serving as a reference for timing control when image display is performed, and the reference clock generator is configured to set a frequency of the main clock signal in a case of the image display in the second display mode lower than a frequency of the main clock signal in a case of the image display in the first display mode.

5. The display device according to claim 1, wherein when a total number of the first sub-frames and the second sub-frames is an odd number, the driver is configured to reverse polarities of the signals to be supplied to the respective pixels on a sub-frame by sub-frame basis, and when the total number of the first sub-frames and the second sub-frames is an even number, the driver is configured to reverse the polarities of the signals to be supplied to the respective pixels at times of transition between the first sub-frames and transition from the second sub-frame to the first sub-frame, and is configured not to reverse the polarities of the signals to be supplied to the respective pixels at a time of transition from the first sub-frame to the second sub-frame.

6. The display device according to claim 1, the display device being configured to reverse polarities of the signals to be supplied to the respective pixels on a frame-by-frame basis, wherein the driver is configured to reverse a scanning direction of the scan lines every two frames.

7. A display device comprising:

an image display panel comprising a plurality of pixels arranged in a matrix, a plurality of scan lines coupled to the respective pixels arranged in a row direction, and a plurality of signal lines coupled to the respective pixels arranged in a column direction; and a driver configured to be supplied with a video signal having a predetermined number of gradations and configured to drive the image display panel, and having:

a first display mode of performing display with the number of gradations of the video signal; and a second display mode of performing the display with a number of gradations smaller than a number of gradations of the video signal and larger than two, wherein the driver is configured to:

supply signals having first gradations to the respective pixels arranged in the column direction in the first display mode;

supply signals having second gradations smaller in number than the first gradations to the respective pixels arranged in the column direction in the second display mode, amplify, by first amplifiers in the first display mode, signals to be supplied to the respective pixels arranged, amplify, by second amplifiers in the second display mode, gradation signals in one horizontal period, the second amplifiers being smaller in number than the first amplifiers, and temporally divide the image for one frame into at least one first sub-frame and at least one second sub-frame, wherein each of the first sub-frame and the second sub-frame includes a dummy period in which horizontal scanning is performed while stopping outputs of the second amplifiers.

* * * * *